US005206105A

United States Patent [19]

Kato

[11] Patent Number: 5,206,105

[45] Date of Patent: Apr. 27, 1993

[54] ELECTROPHOTOGRAPHIC LIGHT-SENSITIVE MATERIAL

[75] Inventor: Eiichi Kato, Shizuoka, Japan

[73] Assignee: Fuji Photo Film Co., Ltd., Kanagawa, Japan

[21] Appl. No.: 702,575

[22] Filed: May 20, 1991

[30] Foreign Application Priority Data

May 21, 1990 [JP] Japan ..... 2-129263

[51] Int. Cl.[5] ..... G03G 5/08

[52] U.S. Cl. ..... 430/96; 430/49; 430/87

[58] Field of Search ..... 430/96, 49, 87

[56] References Cited

U.S. PATENT DOCUMENTS 5,009,975 4/1991 Kato et al. ..... 430/96

OTHER PUBLICATIONS

U.S. patent application Ser. No. 07/655,606, Kato filed Feb. 15, 1991.

*Primary Examiner*—Marion E. McCamish
*Assistant Examiner*—Mark A. Chapman
*Attorney, Agent, or Firm*—Sughrue, Mion, Zinn, Macpeak & Seas

[57] ABSTRACT

An electrophotographic light-sensitive material comprising a support having provided thereon a photoconductive layer containing at least an inorganic photoconductive substance and a binder resin, wherein the binder resin comprises (A) at least one AB block copolymer (Resin (A)) having a weight average molecular weight of from $1\times10^3$ to $2\times10^4$ and composed of an A block comprising at least one polymer component containing at least one acidic group selected from $-PO_3H_2$, $-COOH$, $-SO_3H$, a phenolic hydroxy group, (wherein R represents a hydrocarbon group or —OR′ (wherein R′ represents a hydrocarbon group)) and a cyclic acid anhydride-containing group, and a B block containing at least a polymer component represented by the following general formula (I):

(I)

wherein $R_1$ represents a hydrocarbon group; and (B) at least one graft type copolymer (Resin (B)) having a weight average molecular weight of from $3\times10^4$ to $1\times10^6$ and containing, as a copolymerizable component, at least one monofunctional macromonomer (M) having a weight average molecular weight of from $1\times10^3$ to $2\times10^4$ and comprising an MAB block copolymer composed of an MA block comprising at least one polymer component containing at least one acidic group selected from $-PO_3H_2$, $-COOH$, $-SO_3H$, a phenolic hydroxyl group, (wherein $R_0$ represents a hydrocarbon group or $-OR_0'$ (wherein $R_0'$ represents a hydrocarbon group)) and a cyclic acid anhydride-containing group, and an MB block containing at least one polymerizable component represented by the general formula (III) described below and having a polymer double bond group bonded to the terminal of the main chain of the MB block polymer:

(Abstract continued on next page.)

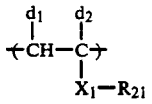

(III)

wherein $d_1$ and $d_2$ each represents a hydrogen atom, a halogen atom, a cyano group, a hydrocarbon group, $—COOR_{24}$ or $—COOR_{24}$ bonded via a hydrocarbon group (wherein $R_{24}$ represents a hydrocarbon group); $X_1$ represents —COO—, —OCO—, $-(CH_2)_{l1}OCO—$, $—CH_2)_{l2}COO—$(wherein $l_1$ and $l_2$ each represents an integer of from 1 to 3), —O—, $—SO_2—$, CO—,

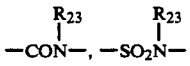

(wherein $R_{23}$ represents a hydrogen atom or a hydrocarbon group), —CONHCOO—, —CONHCONH—, or

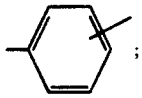

and $R_{21}$ represents a hydrocarbon group, provided that, when $X_1$ represents

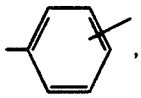

$R_{21}$ represents a hydrogen atom or a hydrocarbon group.

12 Claims, No Drawings

ELECTROPHOTOGRAPHIC LIGHT-SENSITIVE MATERIAL

FIELD OF THE INVENTION

The present invention relates to an electrophotographic light-sensitive material, and more particularly to an electrophotographic light-sensitive material which is excellent in electrostatic characteristics and moisture resistance.

BACKGROUND OF THE INVENTION

An electrophotographic light-sensitive material may have various structures depending upon the characteristics required or an electrophotographic process to be employed.

An electrophotographic system in which the light-sensitive material comprises a support having thereon at least one photoconductive layer and, if desired, an insulating layer on the surface thereof is widely employed. The electrophotographic light-sensitive material comprising a support and at least one photoconductive layer formed thereon is used for the image formation by an ordinary electrophotographic process including electrostatic charging, imagewise exposure, development, and, if desired, transfer.

Furthermore, a process using an electrophotographic light-sensitive material as an offset master plate precursor for direct plate making is widely practiced. In particular, a direct electrophotographic lithographic plate has recently become important as a system for printing in the order of from several hundreds to several thousands prints having a high image quality.

Binders which are used for forming the photoconductive layer of an electrophotographic lightsensitive material are required to be excellent in the film-forming properties by themselves and the capability of dispersing photoconductive powder therein. Also, the photoconductive layer formed using the binder is required to have satisfactory adhesion to a base material or support. Further, the photoconductive layer formed by using the binder is required to have various excellent electrostatic characteristics such as high charging capacity, small dark decay, large light decay, and less fatigue due to prior light-exposure and also have an excellent image forming properties, and the photoconductive layer stably maintains these electrostatic properties in spite of the change of humidity at the time of image formation.

Further, extensive studies have been made for lithographic printing plate precursors using an electrophotographic light-sensitive material, and for such a purpose, binder resins for a photoconductive layer which satisfy both the electrostatic characteristics as an electrophotographic light-sensitive material and printing properties as a printing plate precursor are required.

However, conventional binder resins used for electrophotographic light-sensitive materials have various problems particularly in electrostatic characteristics such as a charging property, dark charge retention characteristic and photosensitivity, and smoothness of the photoconductive layer.

In order to overcome the above problems, JP-A-63-217354, JP-A-1-70761 and JP-A-2-67563 (the term "JP-A" as used herein means an "unexamined Japanese patent application") disclose improvements in the smoothness of the photoconductive layer and electrostatic characteristics by using, as a binder resin, a resin having a low molecular weight and containing from 0.05 to 10% by weight of a copolymer component containing an acidic group in a side chain of the polymer, a resin having a low molecular weight (i.e., a weight average molecular weight (Mw) of from $1\times10^3$ to $1\times10^4$) and having an acidic group bonded at the terminal of the polymer main chain, or a comb-like polymer having an acidic group bonded at the terminal of the polymer main chain thereby obtaining an image having no background stains. Also, JP-A-1-100554 and JP-A-1-214865 disclose a technique using, as a binder resin, a resin containing a polymer component containing an acidic group in a side chain of the copolymer or at the terminal of the polymer main chain and a polymer component having a heat- and/or photo-curable functional group; JP-A-1-102573 and JP-A-2-874 disclose a technique using a resin containing an acidic group in a side chain of the copolymer or at the terminal of the polymer main chain, and a crosslinking agent in combination; JP-A-64-564, JP-A-63-220149, JP-A-63-220148, JP-A-1-280761, JP-A-1-116643 and JP-A-1-169455 disclose a technique using the above described resin having a low molecular weight (a weight average molecular weight of from $1\times10^3$ to $1\times10^4$) and a resin having a high molecular weight (a weight average molecular weight of $1\times10^4$ or more) in combination; JP-A-1-211766 and JP-A-2-34859 disclose a technique using the above described low molecular weight resin and a heat- and/or photo-curable resin in combination; and JP-A-2-53064, JP-A-2-56558 and JP-A-2-103056 disclose a technique using the above described low molecular weight resin and a comb-like polymer in combination. These references disclose that, according to the proposed technique, the film strength of the photoconductive layer can be increased sufficiently and also the mechanical strength of the light-sensitive material can be increased without adversely affecting the above-described electrostatic characteristics owing to the use of a resin containing an acidic group in a side chain of the copolymer or at the terminal of the polymer main chain.

However, it has been found that, even in the case of using these resins, it is yet insufficient to keep the stable performance in the case of greatly changing the environmental conditions from high-temperature and high-humidity to low-temperature and low-humidity. In particular, in a scanning exposure system using a semiconductor laser beam, the exposure time becomes longer and also there is a restriction on the exposure intensity as compared to a conventional overall simultaneous exposure system using a visible light, and hence a higher performance has been required for the electrostatic characteristics, in particular, the dark charge retention characteristics and photosensitivity.

Further, when the scanning exposure system using a semiconductor laser beam is applied to hitherto known light-sensitive materials for electrophotographic lithographic printing plate precursors, various problems may occur in that the difference between $E_{1/2}$ and $E_{1/10}$ is particularly large and the contrast of the reproduced image is decreased. Moreover, it is difficult to reduce the remaining potential after exposure, which results in severe fog formation in duplicated images, and when employed as offset masters, edge marks of originals pasted up appear on the prints, in addition to the insufficient electrostatic characteristics described above.

SUMMARY OF THE INVENTION

The present invention has been made for solving the problems of conventional electrophotographic light-sensitive materials as described above and meeting the requirement for the light-sensitive materials.

An object of the present invention is to provide an electrophotographic light-sensitive material having stable and excellent electrostatic characteristics and giving clear good images even when the environmental conditions during the formation of duplicated images are changed to low-temperature and low-humidity or to high-temperature and high-humidity.

Another object of the present invention is to provide a CPC electrophotographic light-sensitive material having excellent electrostatic characteristics and showing less environmental dependency.

A further object of the present invention is to provide an electrophotographic light-sensitive material effective for a scanning exposure system using a semiconductor laser beam.

A still further object of the present invention is to provide an electrophotographic lithographic printing plate precursor having excellent electrostatic characteristics (in particular, dark charge retention characteristics and photosensitivity), capable of reproducing faithfully duplicated images to original, forming neither overall background stains nor dotted background stains of prints, and showing excellent printing durability.

Other objects of the present invention will become apparent from the following description and examples.

It has been found that the above described objects of the present invention are accomplished by an electrophotographic light-sensitive material comprising a support having provided thereon a photoconductive layer containing at least an inorganic photoconductive substance and a binder resin, wherein the binder resin comprises (A) at least one AB block copolymer (Resin (A)) having a weight average molecular weight of from $1\times10^3$ to $2\times10^4$ and composed of an A block comprising at least one polymer component containing at least one acidic group selected from $-PO_3H_2$, $-COOH$, $-SO_3H$, a phenolic hydroxy group,

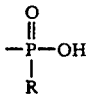

(wherein R represents a hydrocarbon group or —OR' (wherein R' represents a hydrocarbon group)) and a cyclic acid anhydride-containing group, and a B block containing at least a polymer component represented by the following general formula (I):

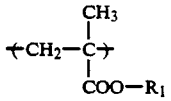

(I)

wherein $R_1$ represents a hydrocarbon group; and (B) at least one graft type copolymer (Resin (B)) having a weight average molecular weight of from $3\times10^4$ to $1\times10^6$ and containing, as a copolymerizable component, at least one monofunctional macromonomer (M) having a weight average molecular weight of from $1\times10^3$ to $2\times10^4$ and comprising an MAB block copolymer composed of an MA block comprising at least one polymerizable component containing at least one acidic group selected from $-PO_3H_2$, $-COOH$, $-SO_3H$, a phenolic hydroxyl group,

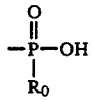

(wherein $R_0$ represents a hydrocarbon group or $-OR)_0'$ (wherein $R_0'$ represents a hydrocarbon group)) and a cyclic acid anhydride-containing group, and an MB block containing at least one polymer component represented by the general formula (III) described below and having a polymerizable double bond group bonded to the terminal of the main chain of the MB block polymer.

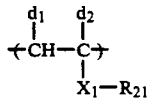

(III)

wherein $d_1$ and $d_2$ each represents a hydrogen atom, a halogen atom, a cyano group or a hydrocarbon group, $-COOR_{24}$ or $-COOR_{24}$ bonded via a hydrocarbon group (wherein $R_{24}$ represents a hydrocarbon group); $X_1$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, $-SO_2-$, —CO—,

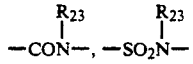

(wherein $R_{23}$ represents a hydrogen atom or a hydrocarbon group), —CONHCOO—, —CONHCONH—, or

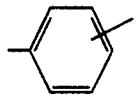

and $R_{21}$ represents a hydrocarbon group, provided that, when $X_1$ represents

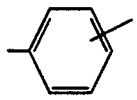

$R_{21}$ represents a hydrogen atom or a hydrocarbon group.

DETAILED DESCRIPTION OF THE INVENTION

The binder resin which can be used in the present invention comprises at least (A) a resin composed of an AB block copolymer (hereinafter referred to as resin (A)) composed of an A block comprising a component containing the above described specific acidic group and a B block comprising a polymer component represented by the above described general formula (I) and (B) a high molecular weight resin (hereinafter referred to as resin (B)) composed of a graft type copolymer containing, as a polymer component, at least one monofunctional macromonomer (M) comprising an MAB block copolymer composed of an MA block comprising a polymer component containing the specific acidic group described above and an MB block comprising a polymer component represented by the general formula (III) described above and having a polymerizable double bond group bonded to the terminal of the main chain of the MB block polymer.

According to a preferred embodiment of the present invention, the low molecular weight resin (A) is a low molecular weight resin (hereinafter referred to as resin (A')) containing an acidic group containing component and a methacrylate component having a specific substituent containing a benzene ring which has a specific substituent(s) at the 2-position or 2- and 6-positions thereof or a specific substituent containing an unsubstituted naphthalene ring represented by the following general formula (Ia) or (Ib):

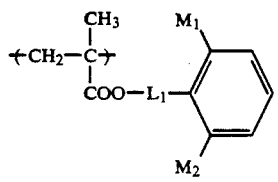

(Ia)

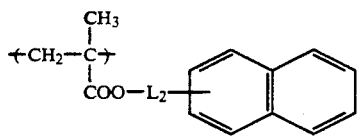

(Ib)

wherein $M_1$ and $M_2$ each represents a hydrogen atom, a hydrocarbon group having from 1 to 10 carbon atoms, a chlorine atom, a bromine atom, $—COZ_2$ or $—COOZ_2$, wherein $Z_2$ represents a hydrocarbon group having from 1 to 10 carbon atoms; and $L_1$ and $L_2$ each represents a mere bond or a linking group containing from 1 to 4 linking atoms, which connects —COO— and the benzene ring.

According to another preferred embodiment of the present invention, the high molecular weight resin (B) is a graft type copolymer containing at least one macromonomer (M) described above and a polymer component represented by the following general formula (IV):

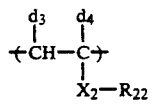

(IV)

wherein $d_3$, $d_4$, $X_2$ and $R_{22}$ each has the same meaning as defined for $d_1$, $d_2$, $X_1$ and $R_{21}$ in the general formula (III) above.

The resin (A) used in the present invention is an AB block copolymer, the A block is composed of at least one polymer component containing at least one acidic group selected from the above-described specific acidic groups and the B block is composed of a polymer component containing at least one of the methacrylate components represented by the general formula (I) described above, and the resin (A) has a weight average molecular weight of from $1\times10^3$ to $2\times10^4$.

The above described conventional low molecular weight resin of acidic group-containing binder resins which were known to improve the smoothness of the photoconductive layer and the electrostatic characteristics was a resin wherein acidic group-containing polymerizable components exist at random in the polymer main chain, or a resin wherein an acidic group was bonded to only one terminal of the polymer main chain.

On the other hand, the resin (A) used for the binder resin of the present invention is a copolymer wherein the acidic groups contained in the resin do not exist at random in the polymer main chain or the acidic group is not bonded to one terminal of the polymer main chain, but the acidic groups are further specified in such a manner that the acidic groups exist as a block in the polymer main chain.

It is presumed that, in the copolymer (resin (A)) used in the present invention, the domain of the portion of the acidic groups maldistributed at one terminal portion of the main chain of the polymer is sufficiently adsorbed on the stoichiometric defect of the inorganic photoconductive substance and other block portion constituting the polymer main chain mildly but sufficiently cover the surface of the photoconductive substance. Also, it is presumed that, even when the stoichiometric defect portion of the inorganic photoconductive substance varies to some extents, it always keeps a stable interaction between the photoconductive substance and the copolymer (resin (A)) used in the present invention since the copolymer has the above described sufficient adsorptive domain by the function and mechanism as described above. Thus, it has been found that, according to the present invention, the traps of the inorganic photoconductive substance are more effectively and sufficiently compensated and the humidity characteristics of the photoconductive substance are improved as compared with conventionally known acidic group-containing resins. Further, in the present invention, particles of the inorganic photoconductive substance are sufficiently dispersed in the binder to restrain the occurrence of the aggregation of the particles of the photoconductive substance.

On the other hand, the resin (B) serves to sufficiently heighten the mechanical strength of the photoconductive layer, which may be insufficient in case of using the resin (A) alone, without damaging the excellent electrophotographic characteristics attained by the use of the resin (A). Further, the excellent image forming performance can be maintained even when the environmental conditions are greatly changed as described above or in the case of conducting a scanning exposure system using a laser beam of low power.

It is believed that the excellent characteristics of the electrophotographic light-sensitive material may be obtained by employing the resin (A) and the resin (B) as binder resins for the inorganic photoconductive substance, wherein the weight average molecular weight of the resins, and the content and position of the acidic groups therein are specified, whereby the strength of interactions between the inorganic photoconductive substance and the resins can be appropriately controlled. More specifically, it is believed that the electrophotographic characteristics and mechanical strength of the layer can be greatly improved as described above by the fact that the resin (A) having a relatively strong interaction to the inorganic photoconductive substance selectively adsorbes thereon; whereas, in the resin (B) which has a weak activity compared with the resin (A), the acidic group bonded to the specific position mildly interacts with the inorganic photoconductive substance to a degree which does not damage the electrophotographic characteristics.

In case of using the resin (A'), the electrophotographic characteristics, particularly, $V_{10}$, DRR and $E_{1/10}$ of the electrophotographic material can be furthermore improved as compared with the use of the resin (A). While the reason for this fact is not fully clear, it is believed that the polymer molecular chain of the resin (A') is suitably arranged on the surface of inorganic photoconductive substance such as zinc oxide in the layer depending on the plane effect of the benzene ring having a substituent at the ortho position or the naphthalene ring which is an ester component of the methacrylate whereby the above described improvement is achieved.

Further, according to the present invention, the smoothness of the photoconductive layer is improved.

When an electrophotographic light-sensitive material having a photoconductive layer with a rough surface is used as an electrophotographic lithographic printing plate precursor, the dispersion state of inorganic particles such as zinc oxide particles as photoconductive substance and a binder resin is improper and thus a photoconductive layer is formed in a state containing aggregates of the photoconductive substance, whereby the surface of the non-image portions of the photoconductive layer is not uniformly and sufficiently rendered hydrophilic by applying thereto an oil-desensitizing treatment with an oil-desensitizing solution to cause attaching of printing ink at printing, which results in the formation of background stains at the non-image portions of prints.

According to the present invention, the interaction of adsorption and covering between the inorganic photoconductive substance and the binder resins is suitably performed, and the sufficient mechanical strength of the photoconductive layer is achieved by the combination of the resins described above.

If the low molecular weight resin (A) according to the present invention is used alone as the binder resin, the resin can sufficiently adsorb onto the photoconductive substance and cover the surface thereof and thus, the photoconductive layer formed is excellent in the surface smoothness and electrostatic characteristics, provides images free from background fog and maintains a sufficient film strength for a CPC light-sensitive material or for an offset printing plate precursor giving several thousands of prints. When the resin (B) is employed together with the resin (A) in accordance with the present invention, the mechanical strength of the photoconductive layer, which may be yet insufficient by the use of the resin (A) alone, can be further increased without damaging the above-described high performance of the electrophotographic characteristics due to the resin (A). Therefore, the electrophotographic light-sensitive material of the present invention can maintain the excellent electrostatic characteristics even when the environmental conditions are widely changed, possess a sufficient film strength and form a printing plate which provides more than 10,000 prints under severe printing conditions, for example, when high printing pressure is applied in a large size printing machine.

Furthermore, it has been found that good photosensitivity can be obtained according to the present invention.

Since spectral sensitizing dyes which are used for giving light sensitivity in the region of visible light to infrared light have a function of sufficiently showing the spectral sensitizing action by adsorbing on photoconductive particles, it can be assumed that the binder resin according to the present invention makes suitable interaction with photoconductive particles without hindering the adsorption of spectral sensitizing dyes onto the photoconductive particles. This effect is particularly remarkable in cyanine dyes or phthalocyanine dyes which are particularly effective as spectral sensitizing dyes for the region of near infrared to infrared light.

The content of the polymerizable component containing the specific acidic group in the AB block copolymer (resin (A)) of the present invention is preferably from 0.5 to 20 parts by weight, and more preferably from 3 to 15 parts by weight per 100 parts by weight of the copolymer.

If the content of the acidic group in the resin (A) is less than 0.5% by weight, the initial potential is low and thus satisfactory image density can not be obtained. On the other hand, if the content of the acidic group is larger than 20% by weight, various undesirable problems may occur, for example, the dispersibility is reduced, the film smoothness and the electrostatic characteristics under high humidity condition are reduced, and further when the light-sensitive material is used as an offset master plate, the occurrence of background stains increases.

The content of the methacrylate component represented by the general formula (I) in the block portion (B block) containing the methacrylate component represented by the general formula (I) is preferably from 30 to 100% by weight, and more preferably from 50 to 100% by weight based on the total weight of the B block.

The weight average molecular weight of the AB block copolymer (resin (A)) is from $1\times10^3$ to $2\times10^4$, and preferably from $3\times10^3$ to $1\times10^4$.

If the weight average molecular weight of the resin (A) is less than $1\times10^3$, the film-forming property of the resin is lowered, thereby a sufficient film strength cannot be maintained, while if the weight average molecular weight of the resin (A) is higher than $2\times10^4$, the effect of the resin (A) of the present invention is reduced, thereby the electrostatic characteristics thereof become almost the same as those of conventionally known resins.

The glass transition point of the resin (A) is preferably from −10° C. to 100° C., and more preferably from −5° C. to 85° C.

Now, the polymer component containing the specific acidic group, which constitutes the A block of the AB block copolymer (resin (A)) used in the present invention will be explained in more detail below.

The acidic group in the A block of the AB block copolymer according to the present invention includes $-PO_3H_2$, —COOH, $-SO_3H$, a phenolic hydroxy group,

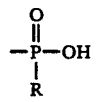

(R represents a hydrocarbon group or —OR' (wherein R' represents a hydrocarbon group)), and a cyclic acidic anhydride-containing group, and the preferred acidic groups are —COOH, —$SO_3H$, a phenolic hydroxy group, and

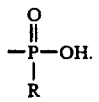

In the

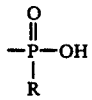

group contained in the resin (A) as an acidic group, R represents a hydrocarbon group or a —OR′ group (wherein R′ represents a hydrocarbon group), and, preferably, R and R′ each represents an aliphatic group having from 1 to 22 carbon atoms (e.g., methyl, ethyl, propyl, butyl, hexyl, octyl, decyl, dodecyl, octadecyl, 2-chloroethyl, 2-methoxyethyl, 3-ethoxypropyl, allyl, crotonyl, butenyl, cyclohexyl, benzyl, phenethyl, 3-phenylpropyl, methylbenzyl, chlorobenzyl, fluorobenzyl, and methoxybenzyl) and an aryl group which may be substituted (e.g., phenyl, tolyl, ethylphenyl, propylphenyl, chlorophenyl, fluorophenyl, bromophenyl, chloromethylphenyl, dichlorophenyl, methoxyphenyl, cyanophenyl, acetamidophenyl, acetylphenyl, and butoxyphenyl).

Examples of the phenolic hydroxy group include a hydroxy group of hydroxy-substituted aromatic compounds containing a polymerizable double bond and a hydroxy group of (meth)acrylic acid esters and amides each having a hydroxyphenyl group as a substituent.

The cyclic acid anhydride-containing group is a group containing at least one cyclic acid anhydride. The cyclic acid anhydride to be contained includes an aliphatic dicarboxylic acid anhydride and an aromatic dicarboxylic acid anhydride.

Specific examples of the aliphatic dicarboxylic acid anhydrides include succinic anhydride ring, glutaconic anhydride ring, maleic anhydride ring, cyclopentane-1,2-dicarboxylic acid anhydride ring, cyclohexane-1,2-dicarboxylic acid anhydride ring, cyclohexene-1,2-dicarboxylic acid anhydride ring, and 2,3-bicyclo[2,2,-2]octanedicarboxylic acid anhydride. These rings may be substituted with, for example, a halogen atom (e.g., chlorine and bromine) and an alkyl group (e.g., methyl, ethyl, butyl, and hexyl).

Specific examples of the aromatic dicarboxylic acid anhydrides include phthalic anhydride ring, naphtnalenedicarboxylic acid anhydride ring, pyridinedicarboxylic acid anhydride ring and thiophenedicarboxylic acid anhydride ring. These rings may be substituted with, for example, a halogen atom (e.g., chlorine and bromine), an alkyl group (e.g., methyl, ethyl, propyl, and butyl), a hydroxyl group, a cyano group, a nitro group, and an alkoxycarbonyl group (e.g., methoxycarbonyl and ethoxycarbonyl).

The above-described "polymer component having the specific acidic group" may be any vinyl compounds each having the acidic group and being capable of copolymerizing with a vinyl compound corresponding to a polymerizable component constituting the B block component in the resin (A) used in the present invention, for example, the methacrylate component represented by the general formula (I) described above.

For example, such vinyl compounds are described in *Macromolecular Data Handbook* (*Foundation*), edited by Kobunshi Gakkai, Baifukan (1986). Specific examples of the vinyl compound are acrylic acid, α- and/or β-substituted acrylic acid (e.g., α-acetoxy compound, α-acetoxymethyl compound, α-(2-amino)ethyl compound, α-chloro compound, α-bromo compound, α-fluoro compound, α-tributylsilyl compound, α-cyano compound, β-chloro compound, β-bromo compound, α-chloro-β-methoxy compound, and α,β-dichloro compound), methacrylic acid, itaconic acid, itaconic acid half esters, itaconic acid half amides, crotonic acid, 2-alkenylcarboxylic acids (e.g., 2-pentenoic acid, 2-methyl-2-hexenoic acid, 2-octenoic acid, 4-methyl-2-hexenoic acid, and 4-ethyl-2-octenoic acid), maleic acid, maleic acid half esters, maleic acid half amides, vinylbenzenecarboxylic acid, vinylbenzenesulfonic acid, vinylsulfonic acid, vinylphosphonic acid, half ester derivatives of the vinyl group or allyl group of dicarboxylic acids, and ester derivatives or amide derivatives of these carboxylic acids or sulfonic acids having the acidic group in the substituent thereof.

Specific examples of the compounds having the specific acidic group are set forth below, but the present invention should not be construed as being limited thereto. In the following examples, a represents —H, —$CH_3$, —Cl, —Br, —CN, —$CH_2COOCH_3$, or —$CH_2COOH$; b represents —H or —$CH_3$, n represents an integer of from 2 to 18; m represents an integer of from 1 to 12; and l represents an integer of from 1 to 4.

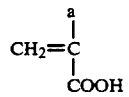
(a-1)

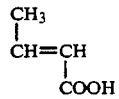
(a-2)

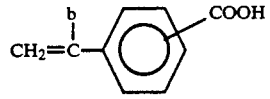
(a-3)

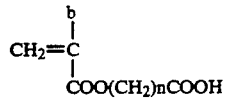
(a-4)

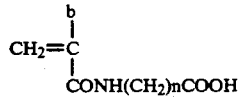
(a-5)

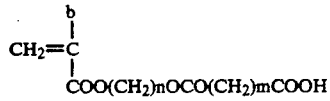
(a-6)

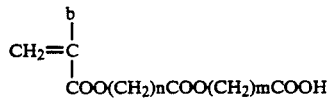
(a-7)

-continued
(a-8)
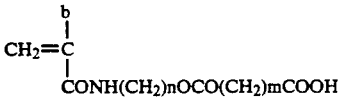
(a-9)
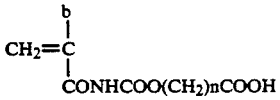
(a-10)
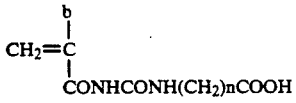
(a-11)
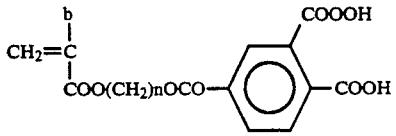
(a-12)
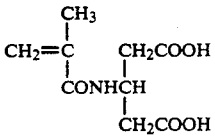
(a-13)
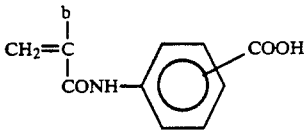
(a-14)
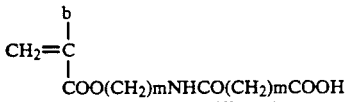
(m's may be the same or different)
(a-15)
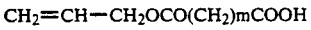
(a-16)
(a-17)
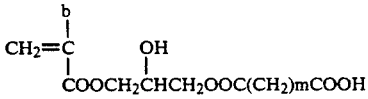
(a-18)
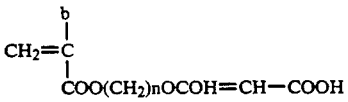
(a-19)
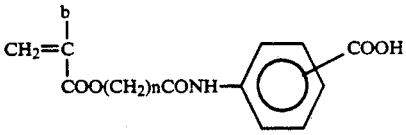
(a-20)
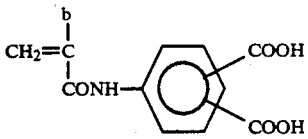
(a-21)
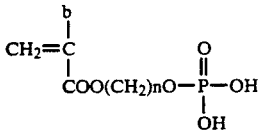
-continued
(a-22)
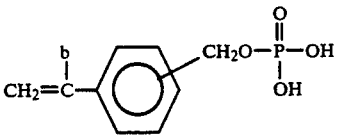
(a-23)
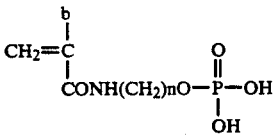
(a-24)
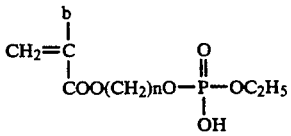
(a-25)
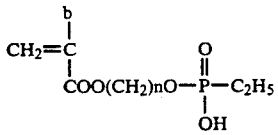
(a-26)
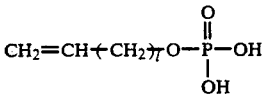
(a-27)
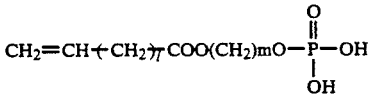
(a-28)
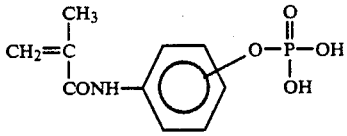
(a-29)
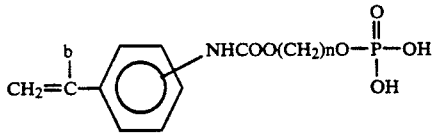
(a-30)
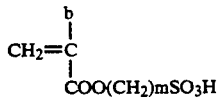
(a-31)
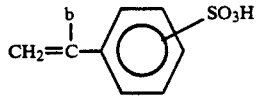
(a-32)
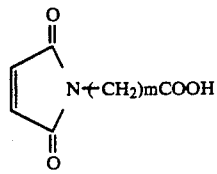

-continued (a-33)

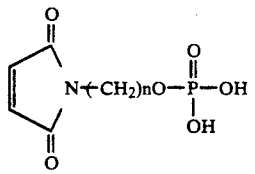

(a-34)

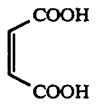

(a-35)

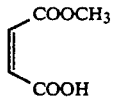

(a-36)

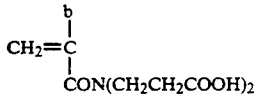

(a-37)

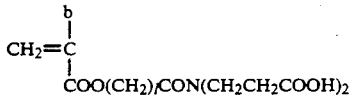

(a-38)

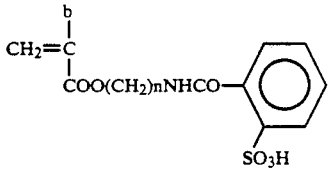

(a-39)

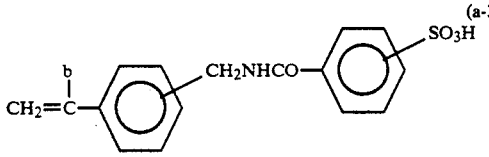

(a-40)

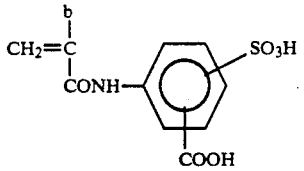

(a-41)

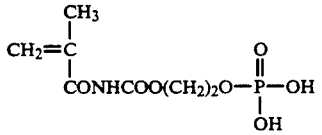

(a-42)

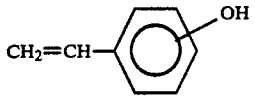

(a-43)

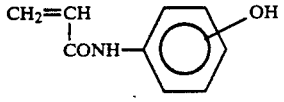

-continued (a-44)

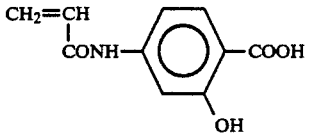

(a-45)

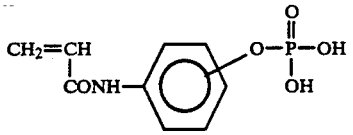

The A block of the AB block copolymer used in the present invention may contain two or more kinds of the polymer components each having the acidic group, and in this case, two or more kinds of these acidic group-containing components may be contained in the A block in the form of a random copolymer or a block copolymer.

Also, other components having no acidic group may be contained in the A block, and examples of such components include the components represented by the general formula (I) above or the general formula (II) described below. The content of the component having no acidic group in the A block is preferably from 0 to 50% by weight, and more preferably from 0 to 20% by weight. It is most preferred that such a component is not contained in the A block.

Now, the polymer component constituting the B block in the AB block copolymer (resin (A)) used in the present invention will be explained in detail below.

The B block contains at least a methacrylate component represented by the above-described general formula (I) and the methacrylate component represented by the general formula (I) is contained in the B block in an amount of preferably from 30 to 100% by weight, and more preferably from 50 to 100% by weight.

In the repeating unit represented by the general formula (I), the hydrocarbon group represented by $R_1$ may be substituted.

In the general formula (I), $R_1$ is preferably a hydrocarbon group having from 1 to 18 carbon atoms, which may be substituted. The substituent for the hydrocarbon group may be any substituent other than the above-described acidic groups contained in the polymer component constituting the A block of the AB block copolymer, and examples of such a substituent are a halogen atom (e.g., fluorine, chlorine, and bromine) and —O—$Z_1$, —COO—$Z_1$, and —OCO—$Z_1$ (wherein $Z_1$ represents an alkyl group having from 1 to 22 carbon atoms, e.g., methyl, ethyl, propyl, butyl, hexyl, octyl, decyl, dodecyl, hexadecyl, and octadecyl). Preferred examples of the hydrocarbon group include an alkyl group having from 1 to 18 carbon atoms which may be substituted (e.g., methyl, ethyl, propyl, butyl, pentyl, hexyl, heptyl, octyl, decyl, dodecyl, hexadecyl, octadecyl, 2-chloroethyl, 2-bromoethyl, 2-cyanoethyl, 2-methoxycarbonylethyl, 2 methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl and dimethoxybenzyl), an alicyclic group having from 5 to 8 carbon atoms which may be substituted (e.g., cyclohexyl, 2 cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

Furthermore, it is preferred that in the resin (A), a part or all of the repeating unit represented by the general formula (I) constituting the B block is the repeating unit represented by the following general formula (Ia) and/or (Ib). Accordingly, it is preferred that at least one repeating unit represented by the following general formula (Ia) or (Ib) is contained in the B block in an amount of at least 30% by weight, and preferably from 50 to 100% by weight.

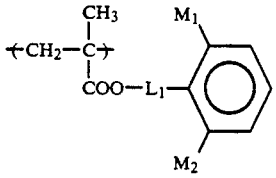
(Ia)

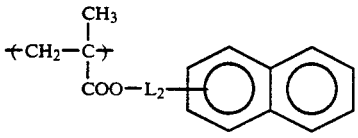
(Ib)

wherein $M_1$ and $M_2$ each represents a hydrogen atom, a hydrocarbon group having from 1 to 10 carbon atoms, a chlorine atom, a bromine atom, $-COZ_2$ or $-COOZ_2$ (wherein $Z_2$ represents a hydrocarbon group having from 1 to 10 carbon atoms): and $L_1$ and $L_2$ each represents a mere bond or a linking group having from 1 to 4 linking atoms, which connects —COO— and the benzene ring.

By incorporating the repeating unit represented by the general formula (Ia) and/or (Ib) into the B block, more improved electrophotographic characteristics (in particular, $V_{10}$, DRR and $E_{1/10}$) can be attained as described above.

In the general formula (Ia), $M_1$ and $M_2$ each preferably represents a hydrogen atom, a chlorine atom, a bromine atom, an alkyl group having from 1 to 4 carbon atoms (e.g., methyl, ethyl, propyl, and butyl), an aralkyl group having from 7 to 9 carbon atoms (e.g., benzyl, phenethyl, 3-phenylpropyl, chlorobenzyl, dichlorobenzyl, bromobenzyl, methylbenzyl, methoxybenzyl, and chloromethylbenzyl), an aryl group (e.g., phenyl, tolyl, xylyl, bromophenyl, methoxyphenyl, chlorophenyl, and dichlorophenyl), $-COZ_2$ or $-COOZ_2$, wherein $Z_2$ preferably represents any of the above-recited hydrocarbon groups for $M_1$ or $M_2$.

In the general formula (Ia), $L_1$ is a mere bond or a linking group containing from 1 to 4 linking atoms which connects between —COO— and the benzene ring, e.g., $-(CH_2)_{n_1}$ (wherein $n_1$ represents an integer of 1, 2 or 3), $-CH_2CH_2OCO-$, $-(CH_2)_{n_2}$ (wherein $n_2$ represents an integer of 1 or 2), and $-CH_2CH_2O-$.

In the general formula (Ib), $L_2$ has the same meaning as $L_1$ in the general (Ia).

Specific examples of the repeating units represented by the general formula (Ia) or (Ib) which are preferably used in the B block of the resin (A) according to the present invention are set forth below, but the present invention is not to be construed as being limited thereto.

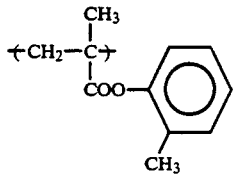
(b-1)

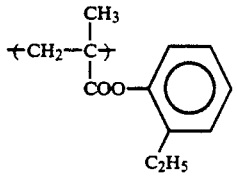
(b-2)

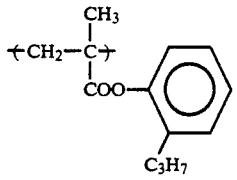
(b-3)

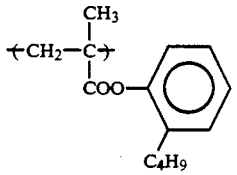
(b-4)

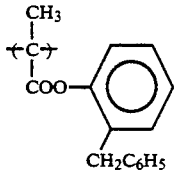
(b-5)

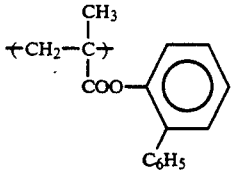
(b-6)

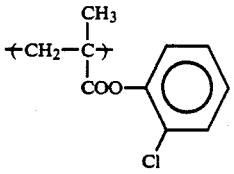
(b-7)

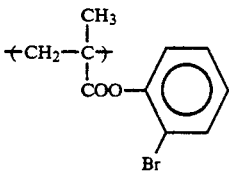
(b-8)

-continued
(b-9)
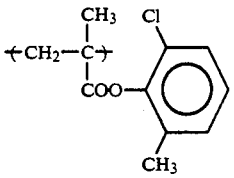
(b-10)
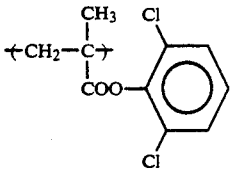
(b-11)
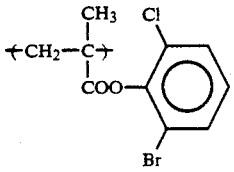
(b-12)
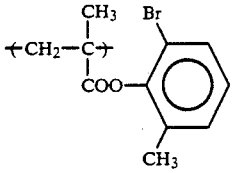
(b-13)
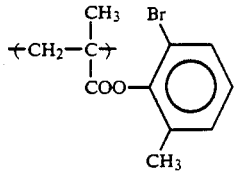
(b-14)
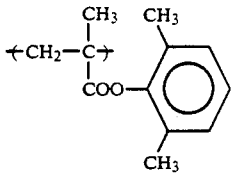
(b-15)
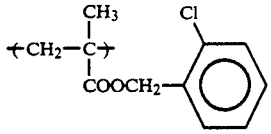
(b-16)
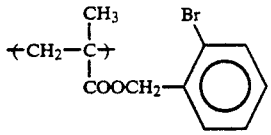
(b-17)
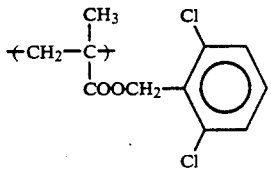
-continued
(b-18)
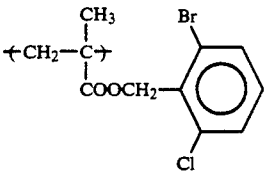
(b-19)
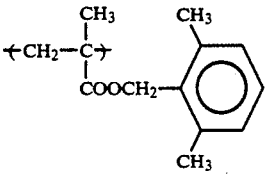
(b-20)
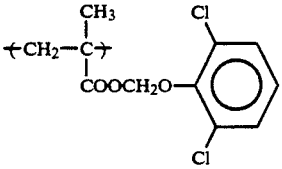
(b-21)
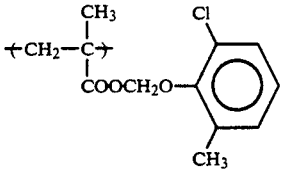
(b-22)
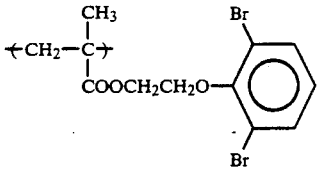
(b-23)
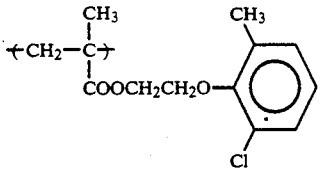
(b-24)
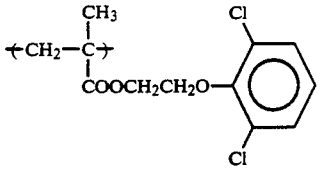
(b-25)
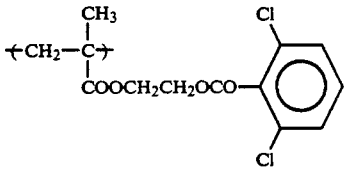
(b-26)
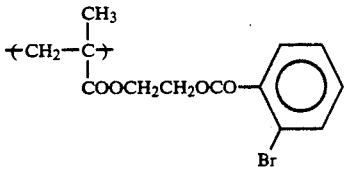

-continued (b-27)

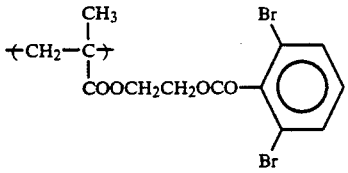

(b-28)

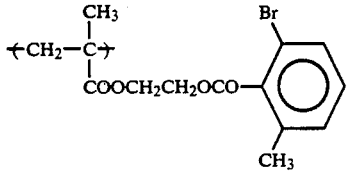

(b-29)

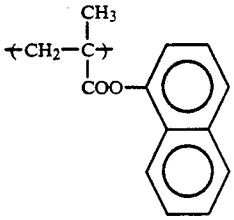

(b-30)

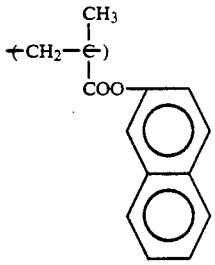

(b-31)

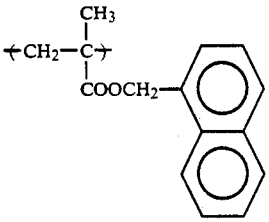

(b-32)

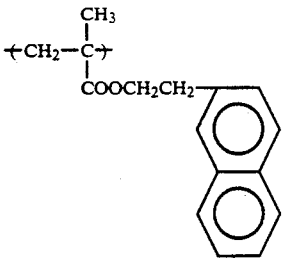

(b-33)

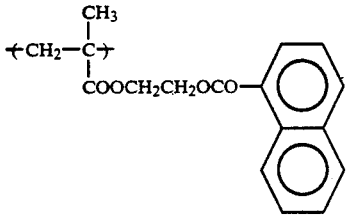

-continued (b-34)

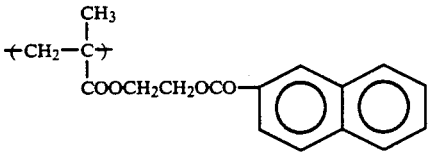

(b-35)

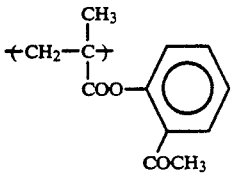

(b-36)

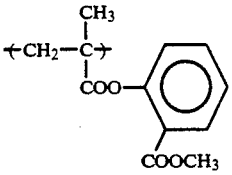

(b-37)

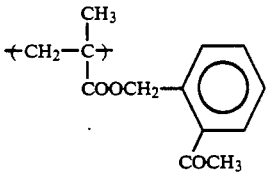

(b-38)

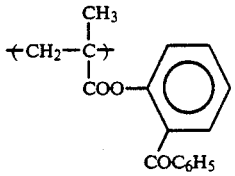

(b-39)

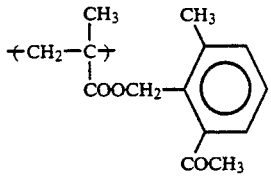

(b-40)

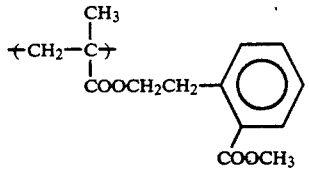

The B block which is constituted separately from the A block composed of the polymerizable component containing the above-described specific acidic group may contain two or more kinds of the repeating units represented by the above described general formula (I) (preferably, those of the general formula (Ia) or (Ib)) and may further contain polymer components other than the above described repeating units. When the B block having no acidic group contains two or more kinds of the polymer components, the polymer components may be contained in the B block in the form of a random copolymer or a block copolymer, but are preferably contained at random therein.

The polymer component other than the repeating units represented by the above described general formula (I), (Ia) and/or (Ib), which is contained in the B block together with the polymer component(s) selected from the repeating units represented by the general formulae (I), (Ia) and (Ib), any components copolymerizable with the repeating units can be used.

Examples of such other components include the repeating unit represented by the following general formula (II):

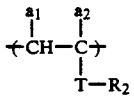

(II)

wherein T represents —COO—, —OCO—, $-(CH_2)_{m_1}$ OCO—, $—CH_2)_{m_2}$ COO—, —O—, $—SO_2—$,

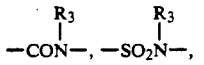

—CONHCO—, —CONHCONH— or

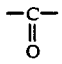

(wherein $m_1$ and $m_2$ each represents an integer of 1 or 2, $R_3$ has the same meaning as $R_1$ in the general formula (I)); $R_2$ has the same meaning as $R_1$ in the general formula (I); and $a_1$ and $a_2$, which may be the same or different, each represents a hydrogen atom, a halogen atom, a cyano group, a hydrocarbon group having from 1 to 8 carbon atoms, —COO—$Z_3$ or —COO—$Z_3$ bonded via a hydrocarbon group having from 1 to 8 carbon atoms (wherein $Z_3$ represents a hydrocarbon group having from 1 to 18 carbon atoms).

More preferably, in the general formula (II) $a_1$ and $a_2$, which may be the same or different, each represents a hydrogen atom, an alkyl group having from 1 to 3 carbon atoms (e.g., methyl, ethyl, and propyl), —COO—$Z_3$ or —$CH_2$COO—$Z_3$ (wherein $Z_3$ preferably represents an alkyl group having from 1 to 18 carbon atoms or an alkenyl group having from 3 to 18 carbon atoms (e.g. methyl, ethyl, propyl, butyl, hexyl, octyl, decyl, dodecyl, tridecyl, tetradecyl, hexadecyl, octadecyl, pentenyl, hexenyl, octenyl, and decenyl), and these alkyl and alkenyl groups may have a substituent as described for the above $R_1$.

Further, other monomers which constitute repeating units other than the above repeating unit include, for example, styrenes (e.g., styrene, vinyltoluene, chlorostyrene, bromostyrene, dichlorostyrene, methoxystyrene, chloromethylstyrene, methoxymethylstyrene, acetoxystyrene, methoxycarbonylstyrene, and methylcarbamoylstyrene), acrylonitrile, methacrylonitrile, acrolein, methacrolein, vinyl group-containing heterocyclic compounds (e.g., N-vinylpyrrolidone, vinylpyridine, vinylimidazole, and vinylthiophene), acryl amide, and methacrylamide, but the other copolymerizable components used in the present invention are not limited to these monomers.

The AB block copolymer (resin (A)) used in the present invention can be produced by a conventionally known polymerization reaction method. More specifically, it can be produced by the method comprising previously protecting the acidic group of a monomer corresponding to the polymer component having the specific acidic group to form a functional group, synthesizing an AB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, and then conducting a protection-removing reaction of the functional group which had been formed by protecting the acidic group by a hydrolysis reaction, a hydrogenolysis reaction, an oxidative decomposition reaction, or a photodecomposition reaction to form the acidic group.

An example thereof is shown by the following reaction scheme (1):

Reaction Scheme (1)

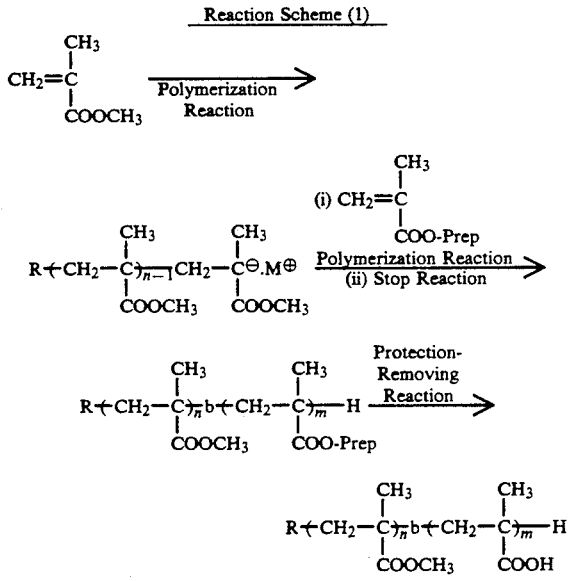

R: Alkyl group, porphyrin ring residue, etc.
Prep: Protective group (e.g., $—C(C_6H_5)_3$, $—Si(C_3H_7)_3$, etc.)
-b-: -b- represents that each of the repeating units bonded to -b- is present in the form of a block polymer component (hereinafter the same).
n, m: Repeating unit The above-described compounds can be easily synthesized according to the synthesis methods described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*). 36, 366 (1987), Toshinobu Higashimura and Mitsuo Sawamoto, *Kobunshi Ronbun Shu* (*Polymer Treatises*, 46, 189 (1989), M. Kuroki and T. Aida, *J. Am. Chem. Soc.*, 109, 4737 (1989), Teizo Aida and Shohei Inoue, *Yuki Gosei Kagaku* (*Organic Synthesis Chemistry*), 43, 300 (1985), and D. Y. Sogah, W. R. Hertler et al, *Macromolecules*, 20, 1473 (1987).

Furthermore, the AB block copolymer (resin (A)) can be also synthesized by a photoinifeter polymerization method using the monomer having the unprotected acidic group and also using a dithiocarbamate compound as an initiator. For example, the block copolymers can be synthesized according to the synthesis methods described, e.g., in Takayuki Otsu, *Kobunshi* (*Polymer*), 37, 248 (1988), Shunichi Himori and Ryuichi Otsu, *Polym. Rep. Jap.* 37, 3508 (1988), JP-A-64-111, and JP-A-64-26619.

Also, the protection of the specific acidic group of the present invention and the release of the protective group (a reaction for removing a protective group) can be easily conducted by utilizing conventionally known knowledges. More specifically, they can be performed by appropriately selecting methods described, e.g., in Yoshio Iwakura and Keisuke Kurita, *Hannosei Kobunshi* (*Reactive Polymer*), Kodansha (1977), T. W. Greene, *Protective Groups in Organic Synthesis,* John Wiley & Sons (1981), and J. F. W. McOmie, *Protective Groups in Organic Chemistry,* Plenum Press, (1973), as well as methods as described in the above references.

In the AB block copolymer (resin (A)), the content of the polymer component having the specific acidic group is from 0.5 to 20 parts by weight and preferably from 3 to 15 parts by weight per 100 parts by weight of the resin (A). The weight average molecular weight of the resin (A) is preferably from $3\times10^3$ to $1\times10^4$.

The binder resin which can be used in the present invention may contain two or more kinds of the above described resins (A) (including the resin (A')).

Now, the resin (B) used in the present invention will be described in detail with reference to preferred embodiments below.

The weight average molecular weight of the resin (B) is suitably from $3\times10^4$ to $1\times10^6$, preferably from $5\times10^4$ to $5\times10^5$.

The glass transition point of the resin (B) is preferably from 0° C. to 110° C., and more preferably from 20° C. to 90° C.

The content of the monofunctional macromonomer comprising an AB block copolymer component in the resin (B) is preferably from 1 to 60% by weight, more preferably from 5 to 50% by weight, and the content of the polymer component represented by the general formula (III) is preferably from 40 to 99% by weight, more preferably from 50 to 95% by weight.

If the molecular weight of the resin (B) is less than $3\times10^4$, a sufficient film strength may not be maintained. On the other hand, if the molecular weight thereof is larger than $1\times10^6$, the dispersibility of the photoconductive substance is reduced, the smoothness of the photoconductive layer is deteriorated, and the image quality of duplicated images (particularly, the reproducibility of fine lines and letters) is degraded. Further, the background stains increase in case of using as an offset master.

Further, if the content of the macromonomer is less than 1% by weight in the resin (B), electrophotographic characteristics (particularly dark decay retention rate and photosensitivity) may be reduced and the fluctuations of electrophotographic characteristics of the photoconductive layer, particularly that containing a spectral sensitizing dye for the sensitization in the range of from near-infrared to infrared become large under severe conditions. The reason therefor is considered that the construction of the polymer becomes similar to that of a conventional homopolymer or random copolymer resulting from the slight amount of macromonomer portion present therein.

On the other hand, if the content of the macromonomer is more than 60% by weight, the copolymerizability of the macromonomer with other monomers corresponding to other copolymer components may become insufficient, and the sufficient electrophotographic characteristics can not be obtained as the binder resin.

The monofunctional macromonomer (M) which can be employed in the resin (B) according to the present invention is described in greater detail below.

The acidic group contained in a component which constitutes the MA block of the macromonomer (M) includes $-PO_3H_2$, $-COOH$, $-SO_3H$, a phenolic hydroxy group,

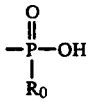

($R_0$ represents a hydrocarbon group or $-OR_0'$ (wherein $R_0'$ represents a hydrocarbon group)), and a cyclic acid anhydride-containing group, and the preferred acidic groups are $-COOH$, $-SO_3H$, a phenolic hydroxy groups, and

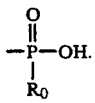

The

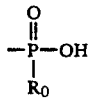

group has the same meaning as defined in the resin (A) above.

Further, specific examples of the polymer components containing the specific acidic group for the resin (B) include those described for the resin (A) above.

Two or more kinds of the above-described polymer components each containing the specific acidic group can be included in the MA block. In such a case, two or more kinds of these acidic group-containing polymer components may be present in the form of a random copolymer or a block copolymer.

Also, other components having no acidic group may be contained in the MA block, and examples of such components include the components represented by the genaral formula (III) described in detail below. The content of the component having no acidic group in the MA block is preferably from 0 to 50% by weight, and more preferably from 0 to 20% by weight. It is most preferred that such a component is not contained in the MA block.

Now, the polymerizable component constituting the MB block in the monofunctional macromonomer of the graft type copolymer (resin (B)) used in the present invention will be explained in more detail below.

The components constituting the MB block in the present invention include at least a repeating unit represented by the general formula (III) described above.

In the general formula (III), $X_1$ represents —COO—, —OCO—, $-(CH_2)_{l_1}OCO-$, $-(CH_2)_{l_2}COO-$ (wherein $l_1$ and $l_2$ each represents an integer of from 1 to 3) —O—, $-SO_2-$, —CO—,

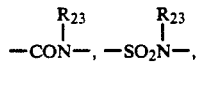

—CONHCOO—, —CONHCONH—, or

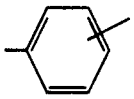

(wherein $R_{23}$ represents a hydrogen atom or a hydrocarbon group).

Preferred examples of the hydrocarbon group represented by $R_{23}$ include an alkyl group having from 1 to 18 carbon atoms which may be substituted (e.g., methyl, ethyl, propyl, butyl, pentyl, hexyl, heptyl octyl, decyl, dodecyl, hexadecyl, octadecyl, 2-chloroethyl, 2-bromoethyl, 2-cyanoethyl, 2-methoxycarbonylethyl, 2-methoxyethyl, and 3-bromopropyl), an alkenyl group having from 4 to 18 carbon atoms which may be substituted (e.g., 2-methyl-1-propenyl, 2-butenyl, 2-pentenyl, 3-methyl-2-pentenyl, 1-pentenyl, 1-hexenyl, 2-hexenyl, and 4-methyl-2-hexenyl), an aralkyl group having from 7 to 12 carbon atoms which may be substituted (e.g., benzyl, phenethyl, 3-phenylpropyl, naphthylmethyl, 2-naphthylethyl, chlorobenzyl, bromobenzyl, methylbenzyl, ethylbenzyl, methoxybenzyl, dimethylbenzyl, and dimethoxybenzyl), an alicyclic group having from 5 to 8 carbon atoms which may be substituted (e.g., cyclohexyl, 2-cyclohexylethyl, and 2-cyclopentylethyl), and an aromatic group having from 6 to 12 carbon atoms which may be substituted (e.g., phenyl, naphthyl, tolyl, xylyl, propylphenyl, butylphenyl, octylphenyl, dodecylphenyl, methoxyphenyl, ethoxyphenyl, butoxyphenyl, decyloxyphenyl, chlorophenyl, dichlorophenyl, bromophenyl, cyanophenyl, acetylphenyl, methoxycarbonylphenyl, ethoxycarbonylphenyl, butoxycarbonylphenyl, acetamidophenyl, propioamidophenyl, and dodecyloylamidophenyl).

In the general formula (III), $R_{21}$ represents a hydrocarbon group, and preferred examples thereof include those described for $R_{23}$. When $X_1$ represents

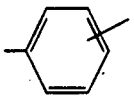

in the general formula (III), $R_{21}$ represents a hydrogen atom or a hydrocarbon group.

When $X_1$ represents

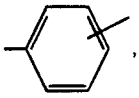

the benzene ring may be substituted. Suitable examples of the substituents include a halogen atom (e.g., chlorine, and bromine), an alkyl group (e.g., methyl, ethyl, propyl, butyl, chloromethyl, and methoxymethyl), and an alkoxy group (e.g., methoxy, ethoxy, propoxy, and butoxy).

In the general formula (III), $d_1$ and $d_2$, which may be the same or different, each preferably represents a hydrogen atom, a halogen atom (e.g., chlorine, and bromine), a cyano group, an alkyl group having from 1 to 4 carbon atoms (e.g., methyl, ethyl, propyl, and butyl), —COO—$R_{24}$ or —COO—$R_{24}$ bonded via a hydrocarbon group, wherein $R_{24}$ represents a hydrocarbon group (preferably an alkyl group having 1 to 18 carbon atoms, an alkenyl group having 4 to 18 carbon atoms, an aralkyl group having 7 to 12 carbon atoms, an alicyclic group having 5 to 8 carbon atoms or an aryl group having 6 to 12 carbon atoms, each of which may be substituted). More specifically, the examples of the hydrocarbon groups are those described for $R_{23}$ above. The hydrocarbon group via which —COO—$R_{24}$ is bonded includes, for example, a methylene group, an ethylene group, an a propylene group.

More preferably, in the general formula (III), $X_1$ represents —COO—, —OCO—, —$CH_2$OCO—, —$CH_2$COO—, —O—, —CONH—, —$SO_2$HN— or

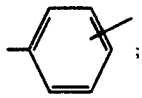

and $d_1$ and $d_2$, which may be the same or different, each represents a hydrogen atom, a methyl group, —$COOR_{21}$, or —$CH_2COOR_{24}$, wherein $R_{24}$ represents an alkyl group having from 1 to 6 carbon atoms (e.g., methyl, ethyl, propyl, butyl, and hexyl). Most preferably, either one of $d_1$ and $d_2$ represents a hydrogen atom.

The MB block which is constituted separately from the MA block which is composed of the polymer component containing the above described specific acidic group may contain two or more kinds of the repeating units represented by the general formula (III) described above and may further contain polymer components other than these repeating units. When the MB block having no acidic group contains two or more kinds of the polymer components, the polymer components may be contained in the MB block in the form of a random copolymer or a block copolymer, but are preferably contained at random therein.

As the polymer component other than the repeating units represented by the general formula (III) which is contained in the MB block together with the polymer component(s) selected from the repeating units of the general formula (III), any components copolymer with the repeating units of the general formula (III) can be used.

Suitable examples of monomers corresponding to the repeating unit copolymer with the polymer component represented by the general formula (III), as a polymerizable component in the MB block include acrylonitrile, methacrylonitrile and heterocyclic vinyl compounds (e.g., vinylpyridine, vinylimidazole, vinylpyrrolidone, vinylthiophene, vinylpyrazole, vinyldioxane, and vinyloxazine). Such other monomers are employed in a range of not more than 20 parts by weight per 100 parts by weight of the total polymer components in the MB block.

Further, it is preferred that the MB block does not contain the polymer component containing an acidic group which is a component constituting the MA block.

As described above, the macromonomer (M) to be used in the present invention has a structure of the MAB block copolymer in which a polymerizable double bond group is bonded to one of the terminals of the MB block composed of the polymer component represented by the general formula (III) and the other terminal thereof is connected to the MA block composed of the polymer component containing the acidic group.

The polymerizable double bond group will be described in detail below.

Suitable examples of the polymerizable double bond group include those represented by the following general formula (V):

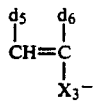

(V)

wherein $X_3$ has the same meaning as $X_1$ defined in the general formula (III), and $d_5$ and $d_6$, which may be the same or different, each has the same meaning as $d_1$ and $d_2$ defined in the general formula (III).

Specific examples of the polymerizable double bond group represented by the general formula (V) include

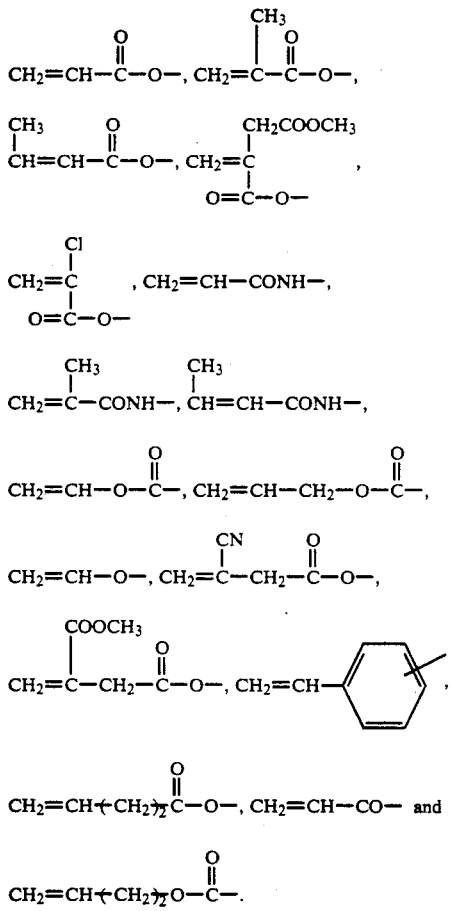

The macromonomer (M) used in the present invention has a structure in which a polymerizable double bond group preferably represented by the general formula (V) is bonded to one of the terminals of the MB block either directly or through an appropriate linking group.

The linking group which can be used includes a carbon-carbon bond (either single bond or double bond), a carbon-hetero atom bond (the hetero atom includes, for example, an oxygen atom, a sulfur atom, a nitrogen atom, and a silicon atom), a hetero atom-hetero atom bond, and an appropriate combination thereof.

More specifically, the bond between the group of the general formula (V) and the terminal of the MB block is a mere bond or a linking group selected from

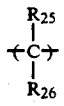

(wherein $R_{25}$ and $R_{26}$ each represents a hydrogen atom, a halogen atom (e.g., fluorine, chlorine, and bromine), a cyano group, a hydroxyl group, or an alkyl group (e.g., methyl, ethyl, and propyl),

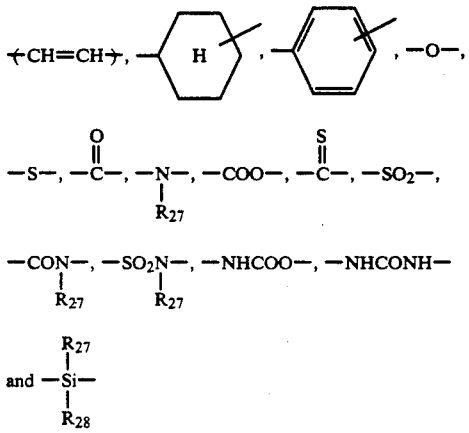

(wherein $R_{27}$ and $R_{28}$ each represents a hydrogen atom or a hydrocarbon group having the same meaning as defined for $R_{21}$ in the general formula (III) described above), and an appropriate combination thereof.

If the weight average molecular weight of the macromonomer (M) exceeds $2\times10^4$, copolymerizability with other monomers is undesirably reduced. If, on the other hand, it is too small, the effect of improving electrophotographic characteristics of the light-sensitive layer would be small. Accordingly, the macromonomer (M) preferably has a weight average molecular weight of at least $1\times10^3$.

The macromonomer (M) used in the present invention can be produced by a conventionally known synthesis method. More specifically, it can be produced by the method comprising previously protecting the acidic group of a monomer corresponding to the polymerizable component having the specific acidic group to form a functional group, synthesizing an MAB block copolymer by a so-called known living polymerization reaction, for example, an ion polymerization reaction with an organic metal compound (e.g., alkyl lithiums, lithium diisopropylamide, and alkylmagnesium halides) or a hydrogen iodide/iodine system, a photopolymerization reaction using a porphyrin metal complex as a catalyst, or a group transfer polymerization reaction, introducing a polymerizable double bond group into the terminal of the resulting living polymer by a reaction with a various kind of reagents, and then conducting a protection-removing reaction of the functional group which has been formed by protecting the acidic group by a hydrolysis reaction, a hydrogenolysis reaction, an oxidative decomposition reaction, or a photodecomposition reaction to form the acidic group.

An example thereof is shown by the following reaction scheme (2):

Reaction Scheme (2)

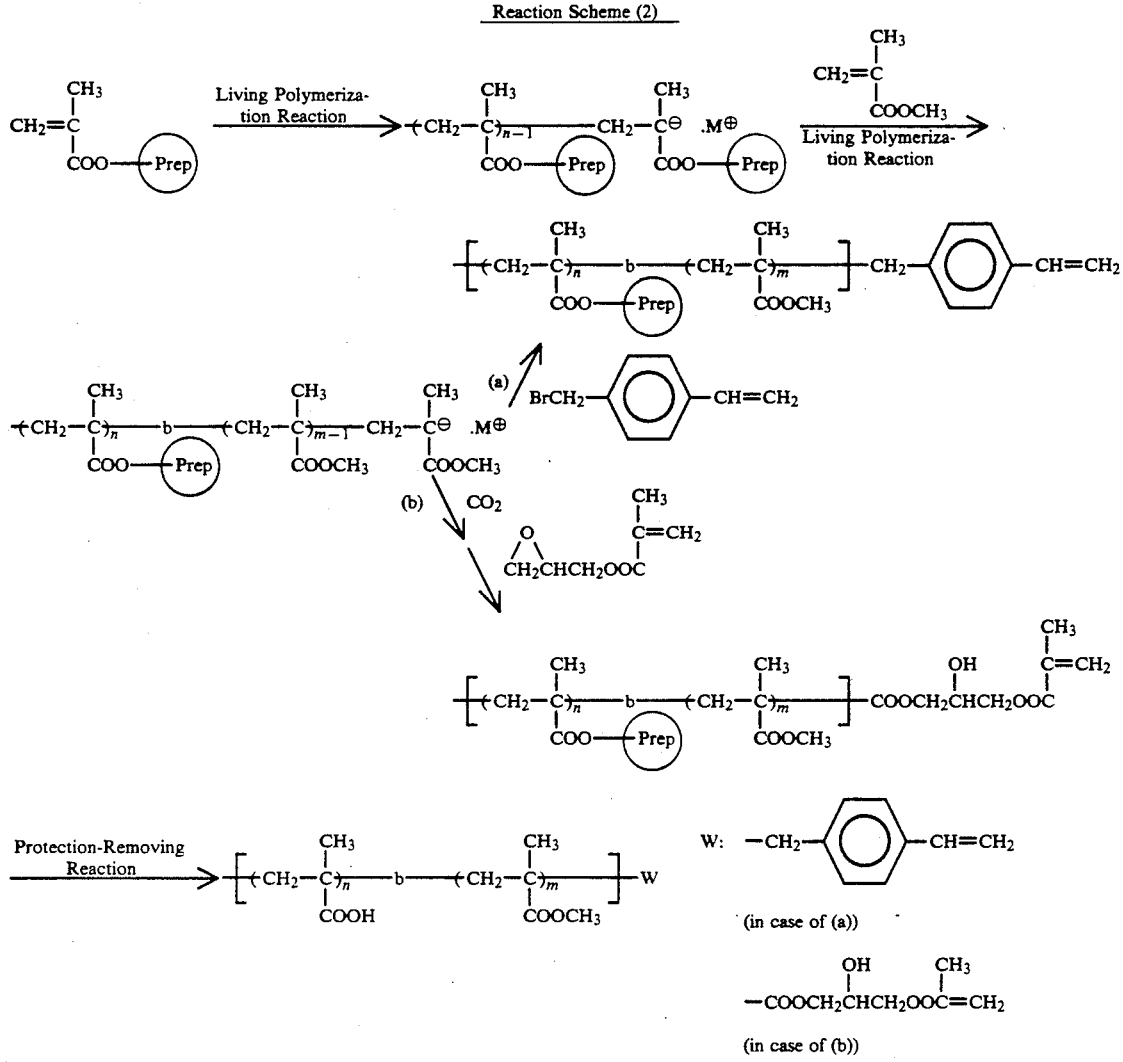

Prep : Protective group for —COOH,

—b—: "—b—" represents that each of the repeating units bonded to —b— is present in the form of a block polymer component (hereinafter the same), n, m: repeating unit The living polymer can be easily synthesized according to synthesis methods as described, e.g., in P. Lutz, P. Masson et al, *Polym. Bull.*, 12, 79 (1984), B. C. Anderson, G. D. Andrews et al, *Macromolecules*, 14, 1601 (1981), K. Hatada, K. Ute et al, *Polym. J.*, 17, 977 (1985), ibid., 18, 1037 (1986), Koichi Migite and Koichi Hatada, *Kobunshi Kako* (*Polymer Processing*), 36, 366 (1987), Toshinobu Higashimura and Mitsuo Sawamoto, *Kobunshi Ronbun Shu* (*Polymer Treatises*), 46, 189 (1989), M. Kuroki and T. Aida, *J. Am. Chem. Soc.*, 109, 4737 (1987), Teizo Aida and Shohei Inoue, *Yuki Gosei Kagaku* (*Organic Synthesis Chemistry*), 43, 300 (1985), and D. Y. Sogoh, W. R. Hertler et al, *Macromolecules*, 20, 1473 (1987).

In order to introduce a polymerizable double bond group into the terminal of the living polymer, a conventionally known synthesis method for macromonomer can be employed.

For details, reference can be made, for example, to P. Dreyfuss and R. P. Quirk, *Encycl. Polym. Sci. Eng*, 7, 551 (1987), P. F. Rempp and E. Franta, *Adv. Polym. Sci.*, 58, 1 (1984), V. Percec, *Appl. Polym. Sci.*, 285, 95 (1984), R. Asami and M. Takari, *Makromol. Chem. Suppl.*, 12, 163 (1985), P. Rempp et al., *Makromol. Chem. Suppl.*, 8, 3 (1984), Yushi Kawakami, *Kogaku Kogyo*, 38, 56 (1987), Yuya Yamashita, *Kobunshi*, 31, 988 (1982), Shiro Kobayashi, *Kobunshi*, 30, 625 (1981), Toshinobu Higashimura, *Nippon Secchaku Kyokaishi*, 18, 536 (1982), Koichi Itoh, *Kobunshi Kako*, 35, 262 (1986), Kishiro Higashi and Takashi Tsuda, *Kino Zairyo*, 1987, No. 10, 5, and references cited in these literatures.

Also, the protection of the specific acidic group of the present invention and the release of the protective group (a reaction for removing a protective group) can be easily conducted by utilizing conventionally known techniques. More specifically, they can be performed by appropriately selecting methods as described, e.g., in Yoshio Iwakura and Keisuke Kurita, *Hannosei Kobunshi* (*Reactive Polymer*), published by Kodansha (1977), T. W. Greene, *Protective Groups in Organic Synthesis*, published by John Wiley & Sons (1981), and J. F. W. McOmie, *Protective Groups in Organic Chemistry*, Plenum Press, (1973), as well as methods as described in the above references.

Furthermore, the MAB block copolymer can also be synthesized by a photoinifeter polymerization method using a dithiocarbamate compound as an initiator. For example, the block copolymer can be synthesized according to synthesis methods as described, e.g., in Takayuki Otsu, *Kobunshi* (*Polymer*), 37, 248 (1988), Shunichi Himori and Ryuichi Ohtsu, *Polym. Rep. Jap.* 37, 3508 (1988), JP-A-64-111, and JP-A-64-26619.

The macromonomer (M) according to the present invention can be obtained by applying the above described synthesis method for macromonomer to the MAB block copolymer.

Specific examples of the macromonomer (M) which can be used in the present invention are set forth below, but the present invention should not be construed as being limited thereto. In the following formulae, $Q_1$, $Q_2$ and $Q_3$ each represents —H, —$CH_3$ or —$CH_2COOCH_3$; $Q_4$ represents —H or —$CH_3$; $R_{31}$ represents —$C_nH_{2+1}$ (wherein n represents an integer of from b 1 to 18),

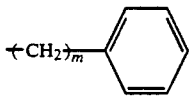

wherein m represents an integer of from 1 to 3),

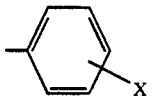

(wherein X represents —H, —Cl, —Br, —$CH_3$, —$OCH_3$ or —$COCH_3$) or

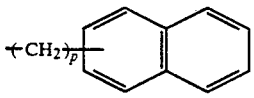

(wherein p represents an integer of from 0 to 3); $R_{32}$ represents —$C_qH_{2q+1}$ (wherein q represents an integer of from 1 to 8) or

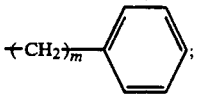

$Y_1$ represents —OH, —COOH, —$SO_3H$,

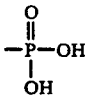

or

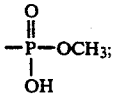

$Y_2$ represents —COOH, —$SO_3H$,

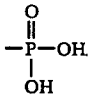

or

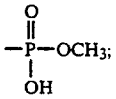

r represents an integer of from 2 to 12; s represents an integer of from 2 to 6; and —b— is as defined above.

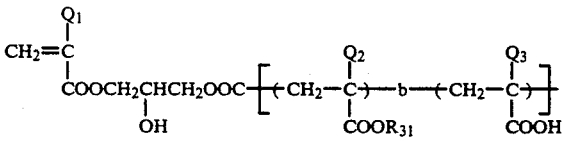

(M-1)

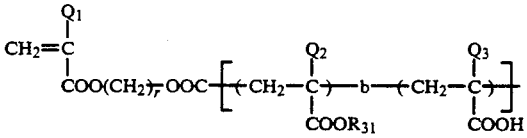

(M-2)

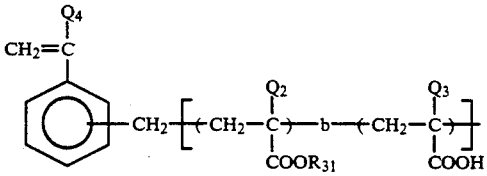

(M-3)

-continued
(M-4)
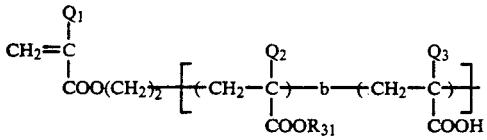
(M-5)
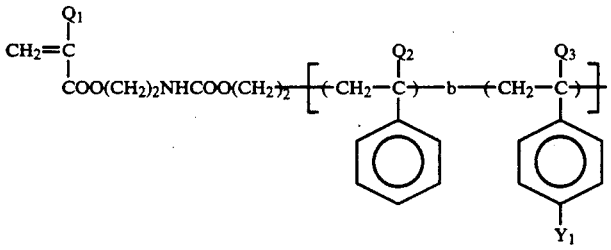
(M-6)
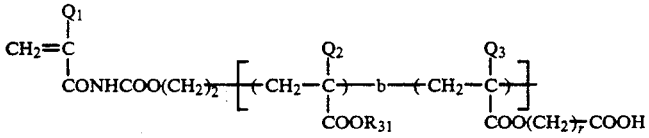
(M-7)
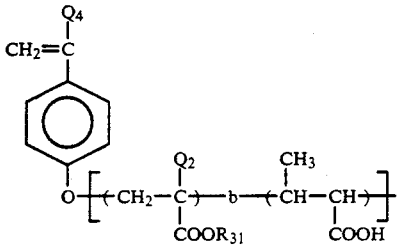
(M-8)
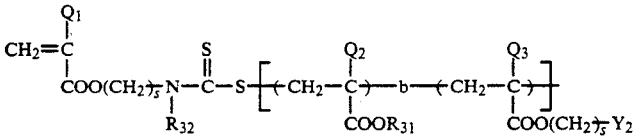
(M-9)
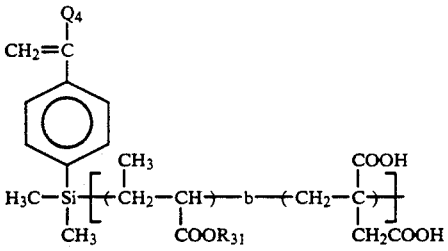
(M-10)
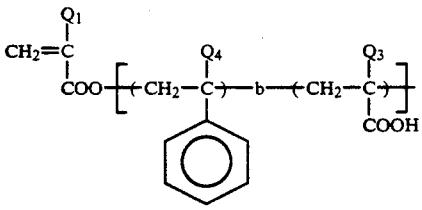
(M-11)
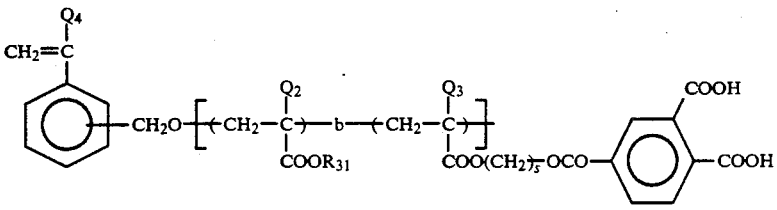

-continued (M-12)

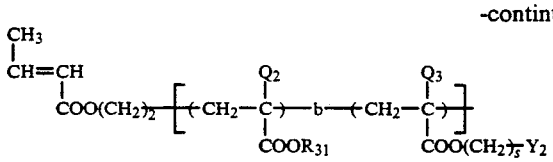

(M-13)

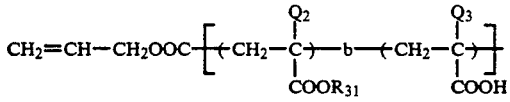

(M-14)

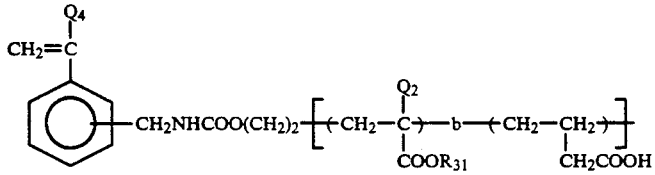

(M-15)

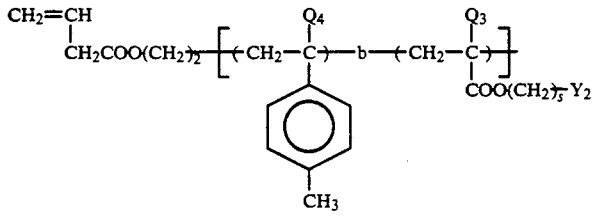

(M-16)

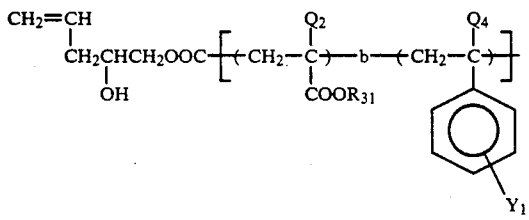

The monomer copolymerizable with the macromonomer (M) described above is preferably selected from those represented by the general formula (IV) described hereinbefore. In the general formula (IV), $d_3$, $d_4$, $X_2$ and $R_{22}$ each has the same meaning as defined for $d_1$, $d_2$, $X_1$ and $R_{21}$ in the general formula (III) as described above. More preferably, $d_3$ represents a hydrogen atom, $d_4$ represents a methyl group, and $X_2$ represents —COO—.

In the resin (B) used in the present invention, a ratio of the MA block to the MB block in the macromonomer (M) preferably ranges 1 to 30/99 to 70 by weight. The content of the acidic group-containing component in the resin (B) is preferably from 0.1 to 20% by weight, more preferably from 0.5 to 10% by weight. A ratio of the copolymerizable component having the macromonomer (M) as a repeating unit to the copolymerizable component having the monomer represented by the general formula (IV) as a repeating unit ranges preferably 1 to 60/99 to 40 by weight, more preferably 5 to 50/95 to 50 by weight.

The binder resins (A) and (B) according to the present invention can be produced by copolymerization of the corresponding monofunctional polymerizable compounds in the desired ratio. The copolymerization can be performed using a known polymerization method, for example, solution polymerization, suspension polymerization, precipitation polymerization, and emulsion polymerization. More specifically, according to the solution polymerization monomers are added to a solvent such as benzene or toluene in the desired ratio and polymerized with an azobis compound, a peroxide compound or a radical polymerization initiator to prepare a copolymer solution. The resulting solution is dried or added to a poor solvent whereby the desired copolymer can be obtained. In case of suspension polymerization, monomers are suspended in the presence of a dispersing agent such as polyvinyl alcohol or polyvinyl pyrrolidone and copolymerized with a radical polymerization initiator to obtain the desired copolymer.

In the production of the resin (A) ($Mw=1\times10^3$ to $2\times10^4$) and the resin (B) ($Mw=3\times10^4$ to $1\times10^6$) according to the present invention, the molecular weight thereof can be easily controlled appropriately by selecting a kind of initiator (a half-life thereof being varied depending on temperature), an amount of initiator, a starting temperature of the polymerization, and co-use of chain transfer agent, as conventionally known.

As the binder resin of the photoconductive layer according to the present invention, a resin which is conventionally used as a binder resin for electrophotographic light-sensitive materials can be employed in combination with the above described binder resin according to the present invention. Examples of such resins are described, for example, in Harumi Miyamoto and Hidehiko Takei, *Imaging*, Nos. 8 and 9 to 12, 1978 and Ryuji Kurita and Jiro Ishiwata, *Kobunshi* (*Polymer*), 17, 278–284 (1968).

Specific examples thereof include an olefin polymer, an olefin copolymer, a vinyl chloride copolymer, a vinylidene chloride copolymer, a vinyl alkanoate polymer, a vinyl alkanoate copolymer, an allyl alkanoate polymer, an allyl alkanoate copolymer, a styrene and styrene derivative polymer, a styrene and styrene derivative copolymer, a butadiene-styrene copolymer, an isoprene-styrene copolymer, a butadiene-unsaturated carboxylic acid ester copolymer, an acrylonitrile copolymer, a methacrylonitrile copolymer, an alkyl vinyl ether copolymer, acrylic acid ester polymer and copolymer, a methacrylic acid ester polymer and copolymer, a styrene-acrylic acid ester copolymer, a styrene-methacrylic acid ester copolymer, itaconic acid diester polymer and copolymer, a maleic anhydride copolymer, an acrylamide copolymer, a methacrylamide copolymer, a hydroxy group-modified silicone resin, a polycarbonate resin, a ketone resin, an amide resin, a hydroxy group- and carboxy group-modified polyester resin, a butyral resin, a polyvinyl acetal resin, a cyclized rubber-methacrylic acid ester copolymer, a cyclized rubber-acrylic acid ester copolymer, a copolymer having a heterocyclic group containing no nitrogen atom (examples of the heterocyclic ring are a furan ring, a tetrahydrofuran ring, a thiophene ring, a dioxane ring, a dioxolan ring, a lactone ring, a benzofuran ring, a benzothiophene ring, and a 1,3-dioxetane ring), and an epoxy resin.

However, it is preferred that such resins are employed in a range of not more than 30% by weight based on the whole binder resin.

The ratio of the resin (A) to the resin (B) is not particularly restricted, but ranges preferably 5 to 50/95 to 50 by weight, more preferably 10 to 40/90 to 60 by weight.

The inorganic photoconductive substance which can be used in the present invention includes zinc oxide, titanium oxide, zinc sulfide, cadmium sulfide, cadmium carbonate, zinc selenide, cadmium selenide, tellurium selenide, and lead sulfide, preferably zinc oxide.

The binder resin is used in a total amount of from 10 to 100 parts by weight, preferably from 15 to 50 parts by weight, per 100 parts by weight of the inorganic photoconductive substance.

If desired, various dyes can be used as spectral sensitizers in the present invention. Examples of the spectral sensitizers are carbonium dyes, diphenylmethane dyes, triphenylmethane dyes, xanthene dyes, phthalein dyes, polymethine dyes (e.g., oxonol dyes, merocyanine dyes, cyanine dyes, rhodacyanine dyes, and styryl dyes), and phthalocyanine dyes (including metallized dyes). Reference can be made to, for example, in Harumi Miyamoto and Hidehiko Takei, *Imaging*, 1973, No. 8, 12, C. J. Young et al., *RCA Review*, 15, 469 (1954), Kohei Kiyota et al., *Denkitsushin Gakkai Ronbunshi*, J 63-C, No. 2, 97 (1980), Yuji Harasaki et al., *Kogyo Kagaku Zasshi*, 66, 78 and 188 (1963), and Tadaaki Tani, *Nihon Shashin Gakkaishi*, 35, 208 (1972).

Specific examples of the carbonium dyes, triphenylmethane dyes, xanthene dyes, and phthalein dyes are described, for example, in JP-B-51-452, JP-A-50-90334, JP-A-50-114227, JP-A-53-39130, JP-A-53-82353, U.S. Pat. Nos. 3,052,540 and 4,054,450, and JP-A-57-16456.

The polymethine dyes such as oxonol dyes, merocyanine dyes, cyanine dyes and rhodacyanine dyes include those described, for example, in F. M. Hamer, *The Cyanine Dyes and Related Compounds*. Specific examples include those described, for example, in U.S. Pat. Nos. 3,047,384, 3,110,591, 3,121,008, 3,125,447, 3,128,179, 3,132,942, and 3,622,317, British Patents 1,226,892, 1,309,274 and 1,405,898, JP-B-48-7814 and JP-B-55-18892.

In addition, polymethine dyes capable of spectrally sensitizing in the longer wavelength region of 700 nm or more, i.e., from the near infrared region to the infrared region, include those described, for example, in JP-A-47-840, JP-A-47-44180, JP-B-51-41061, JP-A-49-5034, JP-A-49-45122, JP-A-57-46245, JP-A-56-35141, JP-A-57-157254, JP-A-61-26044, JP-A-61-27551, U.S. Pat. Nos. 3,619,154 and 4,175,956, and *Research Disclosure*, 216, 117 to 118 (1982).

The light-sensitive material of the present invention is particularly excellent in that the performance properties are not liable to variation even when combined with various kinds of sensitizing dyes.

If desired, the photoconductive layer may further contain various additives commonly employed in conventional electrophotographic light-sensitive layer, such as chemical sensitizers. Examples of such additives include electron-accepting compounds (e.g., halogen, benzoquinone, chloranil, acid anhydrides, and organic carboxylic acids) as described in the above-mentioned *Imaging*, 1973, No. 8, 12; and polyarylalkane compounds, hindered phenol compounds, and p-phenylenediamine compounds as described in Hiroshi Kokado et al., *Saikin-no Kododen Zairyo to Kankotai no Kaihatsu Jitsuyoka*, Chaps. 4 to 6, Nippon Kagaku Joho K. K. (1986).

The amount of these additives is not particularly restricted and usually ranges from 0.0001 to 2.0 parts by weight per 100 parts by weight of the photoconductive substance.

The photoconductive layer suitably has a thickness of from 1 to 100 μm, preferably from 10 to 50 μm.

In cases where the photoconductive layer functions as a charge generating layer in a laminated light-sensitive material composed of a charge generating layer and a charge transporting layer, the thickness of the charge generating layer suitably ranges from 0.01 to 1 μm, particularly from 0.05 to 0.5 μm.

If desired, an insulating layer can be provided on the light-sensitive layer of the present invention. When the insulating layer is made to serve for the main purposes for protection and improvement of durability and dark decay characteristics of the light-sensitive material, its thickness is relatively small. When the insulating layer is formed to provide the light-sensitive material suitable for application to special electrophotographic processes, its thickness is relatively large, usually ranging from 5 to 70 μm, particularly from 10 to 50 μm.

Charge transporting material in the above-described laminated light-sensitive material include polyvinylcarbazole, oxazole dyes, pyrazoline dyes, and triphenylmethane dyes. The thickness of the charge transporting layer ranges from 5 to 40 μm, preferably from 10 to 30 μm.

Resins to be used in the insulating layer or charge transporting layer typically include thermoplastic and thermosetting resins, e.g., polystyrene resins, polyester resins, cellulose resins, polyether resins, vinyl chloride resins, vinyl acetate resins, vinyl chloride-vinyl acetate copolymer resins, polyacrylate resins, polyolefin resins, urethane resins, epoxy resins, melamine resins, and silicone resins.

The photoconductive layer according to the present invention can be provided on any known support. In general, a support for an electrophotographic light-sensitive layer is preferably electrically conductive. Any of conventionally employed conductive supports may be utilized in the present invention. Examples of usable conductive supports include a substrate (e.g., a metal sheet, paper, and a plastic sheet}having been rendered electrically conductive by, for example, impregnating with a low resistant substance; the above-described substrate with the back side thereof (opposite to the light-sensitive layer side) being rendered conductive and having further coated thereon at least one layer for the purpose of prevention of curling; the above-described substrate having provided thereon a water-resistant adhesive layer; the above-described substrate having provided thereon at least one precoat layer; and paper laminated with a conductive plastic film on which aluminum is vapor deposited.

Specific examples of conductive supports and materials for imparting conductivity are described, for example, in Yukio Sakamoto, *Denshishashin*, 14, No. 1, 2 to 11 (1975), Hiroyuki Moriga, *Nyumon Tokushushi no Kagaku*, Kobunshi Kankokai (1975), and M. F. Hoover, *J, Macromol. Sci. Chem.*, A-4(6), 1327 to 1417 (1970).

In accordance with the present invention, an electrophotographic light-sensitive material which exhibits excellent electrostatic characteristics (particularly, under severe conditions) and mechanical strength and provides clear images of good quality can be obtained. The electrophotographic light-sensitive material according to the present invention is suitable for producing a lithographic printing plate. It is also advantageously employed in the scanning exposure system using a semiconductor laser beam.

The present invention will now be illustrated in greater detail with reference to the following examples, but it should be understood that the present invention is not to be construed as being limited thereto.

SYNTHESIS EXAMPLE A-1

Synthesis of Resin (A-1)

A mixed solution of 95 g of ethyl methacrylate, and 200 g of tetrahydrofuran was sufficiently degassed under nitrogen gas stream and cooled to −20° C. Then, 1.5 g of 1,1-diphenylbutyl lithium was added to the mixture, and the reaction was conducted for 12 hours. Furthermore, a mixed solution of 5 g of triphenylmethyl methacrylate and 5 g of tetrahydrofuran was sufficiently degassed under nitrogen gas stream, and, after adding the mixed solution to the above described mixture, the reaction was further conducted for 8 hours. The reaction mixture was adjusted to 0° C. and after adding thereto 10 ml of methanol, the reaction was conducted for 30 minutes and the polymerization was terminated.

The temperature of the polymer solution obtained was raised to 30° C. under stirring and, after adding thereto 3 ml of an ethanol solution of 30% hydrogen chloride, the resulting mixture was stirred for one hour. Then, the solvent of the reaction mixture was distilled off under reduced pressure until the whole volume was reduced to a half, and then the mixture was reprecipitated from one liter of petroleum ether.

The precipitates formed were collected and dried under reduced pressure to obtain 70 g of Resin (A-1) shown below having a weight average molecular weight (hereinafter simply referred to as Mw) of $8.5\times10^3$.

(A-1):

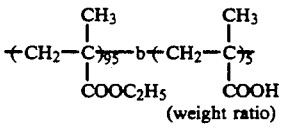

(weight ratio)

SYNTHESIS EXAMPLE A-2

Synthesis of Resin (A-2)

A mixed solution of 46 g of n-butyl methacrylate, 0.5 g of (tetraphenyl prophynato) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 4 g of benzyl methacrylate, after light-irradiating in the same manner as above for 8 hours, 3 g of methanol was added to the reaction mixture followed by stirring for 30 minutes, and the reaction was terminated. Then, Pd-C was added to the reaction mixture, and a catalytic reduction reaction was conducted for one hour at 25° C.

After removing insoluble substances from the reaction mixture by filtration, the reaction mixture was reprecipitated from 500 ml of petroleum ether and the precipitates formed were collected and dried to obtain 33 g of Resin (A 2) shown below having an Mw of $9.3\times10^3$.

(A-2):

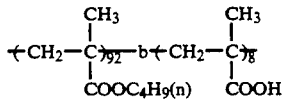

SYNTHESIS EXAMPLE A-3

Synthesis of Resin (A-3)

A mixed solution of 90 g of 2-chloro-6 methylphenyl methacrylate and 200 g of toluene was sufficiently degassed under nitrogen gas stream and cooled to 0° C. Then, 2.5 g of 1,1-diphenyl-3-methylpentyl lithium was added to the mixture followed by stirring for 6 hours. Further, 10 g of 4-vinylphenyloxytrimethylsilane was added to the mixture and, after stirring the mixture for 6 hours, 3 g of methanol was added to the mixture followed by stirring for 30 minutes.

Then, to the reaction mixture was added 10 g of an ethanol solution of 30% hydrogen chloride and, after stirring the mixture at 25° C. for one hour, the mixture was reprecipitated from one liter of petroleum ether. The precipitates thus formed were collected, washed twice with 300 ml of diethyl ether and dried to obtain 58 g of Resin (A-3) shown below having an Mw of $7.8\times10^3$.

(A-3):

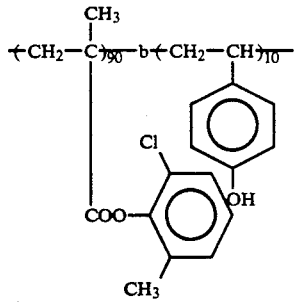

SYNTHESIS EXAMPLE A-4

Synthesis of Resin (A-4)

A mixed solution of 95 g of phenyl methacrylate and 4.8 g of benzyl N,N-diethyldithiocarbamate was placed in a vessel under nitrogen gas stream followed by closing the vessel and heated to 60° C. The mixture was irradiated with light from a high-pressure mercury lamp of 400 W at a distance of 10 cm through a glass filter for 10 hours to conduct photopolymerization.

Then, 5 g of acrylic acid and 180 g of methyl ethyl ketone were added to the mixture and, after replacing the gas in the vessel with nitrogen, the mixture was light-irradiated again for 10 hours.

The reaction mixture was reprecipitated from 1.5 liters of hexane and the precipitates formed were collected and dried to obtain 68 g of Resin (A-4) shown below having an Mw of $9.5\times10^3$.

(A-4)

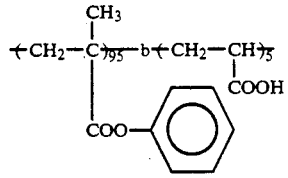

SYNTHESIS EXAMPLE M-1

Synthesis of Macromonomer (M-1)

A mixed solution of 10 g of triphenylmethyl methacrylate, and 100 g of toluene was sufficiently degassed under nitrogen gas stream and cooled to −20° C. Then, 0.02 g of 1,1-diphenylbutyl lithium was added to the mixture, and the reaction was conducted for 10 hours. Separately, a mixed solution of 90 g of ethyl methacrylate and 100 g of toluene was sufficiently degassed under nitrogen gas stream and the resulting mixed solution was added to the above described mixture, and then reaction was further conducted for 10 hours. The reaction mixture was adjusted to 0° C., and carbon dioxide gas was passed through the mixture in a flow rate of 60 ml/min for 30 minutes, then the polymerization reaction was terminated.

The temperature of the reaction solution obtained was raised to 25° C. under stirring, 6 g of 2-hydroxyethyl methacrylate was added thereto, then a mixed solution of 10 g of dicyclohexylcarbodiimide, 0.2 g of 4-N,N-dimethylaminopyridine and 30 g of methylene chloride was added dropwise thereto over a period of 30 minutes, and the mixture was stirred for 3 hours.

After removing the insoluble substances deposited from the reaction mixture by filtration, 10 ml of an ethanol solution of 30 % by weight hydrogen chloride was added to the filtrate and the mixture was stirred for one hour. Then, the solvent of the reaction mixture was distilled off under reduced pressure until the whole volume was reduced to a half, and the mixture was reprecipitated from one liter of petroleum ether.

The precipitates thus formed were collected and dried under reduced pressure to obtain 56 g of Macromonomer (M-1) shown below having an Mw of $6.5\times10^3$.

(M-1)

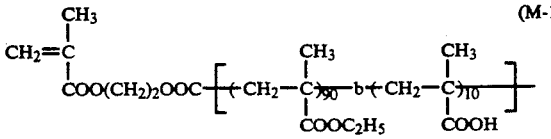

SYNTHESIS EXAMPLE M-2

Synthesis of Macromonomer (M-2)

A mixed solution of 5 g of benzyl methacrylate, 0.01 g of (tetraphenyl porphinate) aluminum methyl, and 60 g of methylene chloride was raised to a temperature of 30° C. under nitrogen gas stream. The mixture was irradiated with light from a xenon lamp of 300 W at a distance of 25 cm through a glass filter, and the reaction was conducted for 12 hours. To the mixture was further added 45 g of butyl methacrylate, after similarly light-irradiating for 8 hours, 5 g of 4-bromomethylstyrene was added to the reaction mixture followed by stirring for 30 minutes, then the reaction was terminated. Then, Pd-C was added to the reaction mixture, and a catalytic reduction reaction was conducted for one hour at 25° C. precipitated from 500 ml of petroleum ether and the precipitates thus formed were collected and dried to obtain 33 g of Macromonomer (M-2) shown below having an Mw of $7\times10^3$.

(M-2)

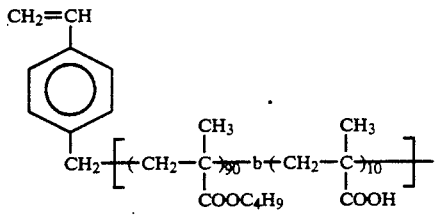

SYNTHESIS EXAMPLE M-3

Synthesis of Macromonomer (M-3)

A mixed solution of 20 g of 4-vinylphenyloxytrimethylsilane and 100 g of toluene was sufficiently degassed under nitrogen has stream and cooled to 0° C. Then, 0.1 g of 1,1-diphenyl-3-methylpentyl lithium was added to the mixture followed by stirring for 6 hours. Separately, a mixed solution of 80 g of 2-chloro-6-methylphenyl methacrylate and 100 g of toluene was sufficiently degassed under nitrogen gas stream and the resulting mixed solution was added to the above described mixture, and then reaction was further conducted for 8 hours. After introducing ethylene oxide in a flow rate of 30 ml/min into the reaction mixture for 30 minutes with vigorously stirring, the mixture was cooled to a temperature of 15° C., and 8 g of methacrylic chloride was added dropwise thereto over a period of 30 minutes, followed by stirring for 3 hours.

Then, to the reaction mixture was added 10 ml of an ethanol solution of 30% by weight hydrogen chloride and, after stirring the mixture for one hour at 25° C., the mixture was reprecipitated from one liter of petroleum ether. The precipitates thus formed were collected, washed twice with 300 ml of diethyl ether and dried to obtain 55 g of Macromonomer (M-3) shown below having an Mw of $7.8\times10^3$.

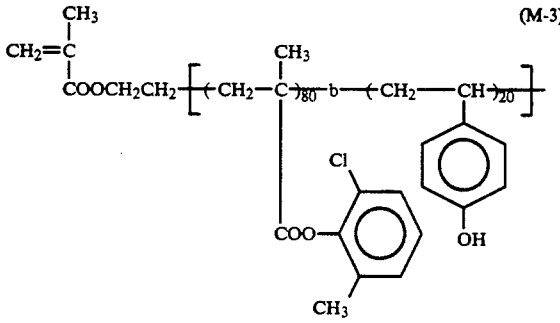

(M-3)

SYNTHESIS EXAMPLE M-4

Synthesis of Macromonomer (M-4)

A mixed solution of 15 g of triphenylmethyl acrylate and 100 g of toluene was sufficiently degassed under nitrogen gas stream and cooled to −20° C. Then, 0.1 g of sec-butyl lithium was added to the mixture, and the reaction was conducted for 10 hours. Separately, a mixed solution of 85 g of styrene and 100 g of toluene was sufficiently degassed under nitrogen gas stream and the resulting mixed solution was added to the above described mixture, and then reaction was further conducted for 12 hours. The reaction mixture was adjusted to 0° C., 8 g of benzyl bromide was added thereto, and the reaction was conducted for one hour, followed by reacting at 25° C. for 2 hours.

Then, to the reaction mixture was added 10 ml of an ethanol solution of 30% by weight hydrogen chloride, followed by stirring for 2 hours. After removing the insoluble substances from the reaction mixture by filtration, the mixture was reprecipitated from one liter of n-hexane. The precipitates thus formed were collected and dried under reduced pressure to obtain 58 g of Macromonomer (M-4) shown below having an Mw of $4.5\times10^3$.

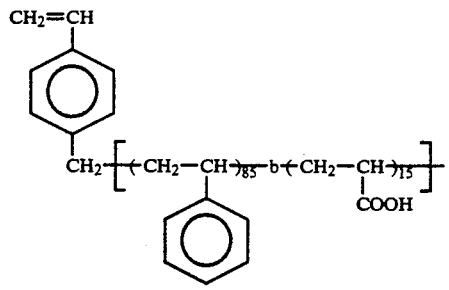

(M-4)

SYNTHESIS EXAMPLE M-5

Synthesis of Macromonomer (M-5)

A mixed solution of 80 g of phenyl methacrylate and 4.8 g of benzyl N-hydroxyethyl-N-ethyldithiocarbamate was placed in a vessel under nitrogen gas stream followed by closing the vessel and heated to 60° C. The mixture was irradiated with light from a high-pressure mercury lamp for 400 W at a distance of 10 cm through a glass filter for 10 hours to conduct a photopolymerization.

Then, 20 g of acrylic acid and 180 g of methyl ethyl ketone were added to the mixture and, after replacing the gas in the vessel with nitrogen, the mixture was light-irradiated again for 10 hours.

To the reaction mixture was added dropwise 6 g of 2-isocyanatoethyl methacrylate at 30° C. over a period of one hour and the mixture was stirred for 2 hours. The reaction mixture was reprecipitated from 1.5 liters of hexane and the precipitates thus formed were collected and dried to obtain 68 g of Macromonomer (M-5) shown below having an Mw of $6.0\times10^3$.

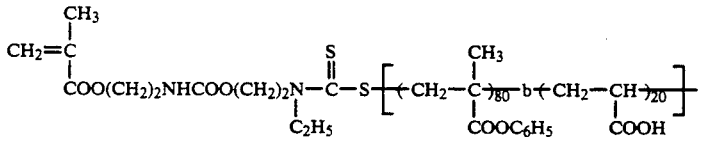

(M-5)

SYNTHESIS EXAMPLE B-1

Synthesis of Resin (B-1)

A mixed solution of 80 g of ethyl methacrylate, 20 g of Macromonomer (M-1) and 150 g of toluene was heated at 85° C. under nitrogen gas stream, and 0.8 g of 1,1-azobis(cyclohexane-1-carbonitrile) (hereinafter simply referred to as ABCC) to effect reaction for 5 hours. Then, 0.5 g of ABCC was further added thereto, followed by reacting for 5 hours. The resulting copolymer shown below had an Mw of $1.0\times10^5$.

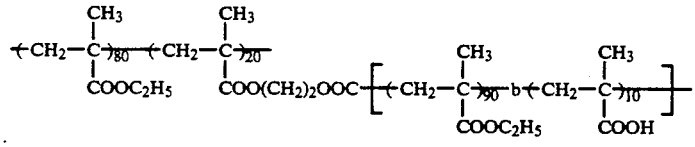

(B-1)

SYNTHESIS EXAMPLE B-2

Synthesis of Resin (B-2)

A mixed solution of 70 g of butyl methacrylate, 30 g of Macromonomer (M-1), and 150 g of toluene was heated at 70° C. under nitrogen gas stream, and 0.5 g of 2,2'-azobisisobutyronitrile (hereinafter simply referred to as AIBN) was added thereto to effect reaction for 6 hours. Then, 0.3 g of AIBN was further added, followed by reacting for 4 hours and thereafter 0.3 g of AIBN was further added, followed by reacting for 4 hours. The resulting copolymer shown below had an Mw of $8.5\times10^4$.

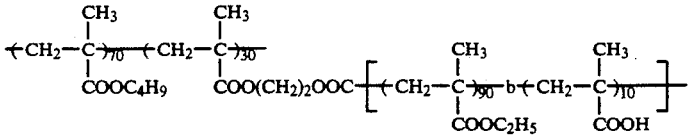

(B-2)

SYNTHESIS EXAMPLES B-3 TO B-9

Synthesis of Resins (B-3) to (B-9)

Resins (B) shown in Table 1 below were synthesized under the same polymerization conditions as described in Synthesis Example B-2. Each of these resins had an Mw of from $7\times10^4$ to $9\times10^4$.

TABLE 1
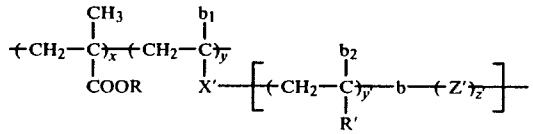
| Synthesis Example No. | Resin (B) | —R | —X'— | x/y | $b_1/b_2$ | —R' | —Z' | y'/z' |
|---|---|---|---|---|---|---|---|---|
| 3 | B-3 | $-CH_3$ | $-COO(CH_2)_2OOC-$ | 90/10 | $-CH_3/-CH_3$ | $-COOC_4H_9$ | $-CH_2-C(CH_3)(COOH)-$ | 90/10 |
| 4 | B-4 | $-C_3H_7(n)$ | 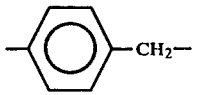 | 80/20 | $-H/-CH_3$ | $-COOC_2H_5$ | 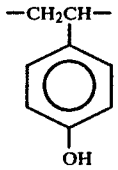 | 80/20 |
| 5 | B-5 | $-CH_2C_6H_5$ | $-COO(CH_2)_2-$ | 90/10 | $-H/-CH_3$ | $-OC_2H_5$ | $-CH_2-C(CH_3)(COO(CH_2)_4SO_3H)-$ | 95/5 |
| 6 | B-6 | $-C_2H_5$ | $-COO-$ | 90/10 | $-CH_3/-CH_3$ | $-COOC_2H_5$ | $-CH_2-CH(COOH)-$ | 90/10 |
| 7 | B-7 | " | $-COO(CH_2)_2NHCOO-$ $(CH_2)_z$ | 90/10 | $-CH_3/-H$ | $-COOC_3H_7$ | 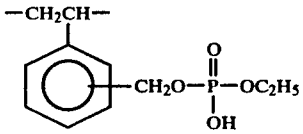 | 85/15 |
| 8 | B-8 | $-CH_2C_6H_5$ | 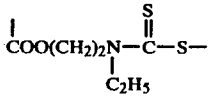 | 90/10 | $-H/-CH_3$ | $-COOC_2H_5$ | 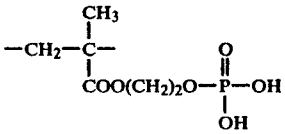 | 92/8 |

TABLE 1-continued
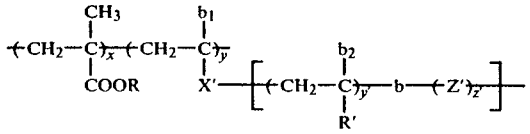
| Synthesis Example No. | Resin (B) | —R | —X'— | x/y | $b_1/b_2$ | —R' | —Z' | y'/z' |
|---|---|---|---|---|---|---|---|---|
| 9 | B-9 | $-C_2H_5$ | —COO— | 85/15 | —H/—H | 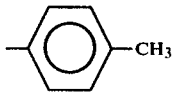 | 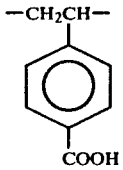 | 90/10 |

SYNTHESIS EXAMPLES B-10 TO B-20

Synthesis of Resins (B-10) to (B-20)

Resins (B) shown in Table 2 below were synthesized under the same polymerization conditions as described in Synthesis Example B-1. Each of these resins had an Mw of from $9\times10^4$ to $2\times10^5$.

TABLE 2

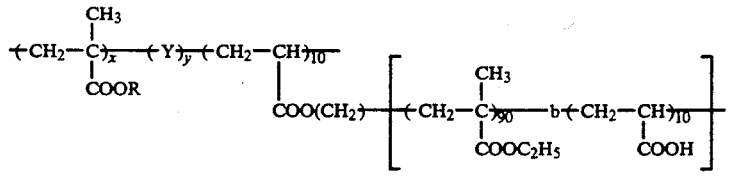

x + y + 10 = 100 (by weight)

| Synthesis Example No. | Resin (B) | —R | —Y— | x/y |
|---|---|---|---|---|
| 10 | B-10 | $-C_2H_5$ | $-CH_2-CH(COOCH_3)-$ | 70/20 |
| 11 | B-11 | $-CH_3$ | $-CH_2-CH(COOC_2H_5)-$ | 75/15 |
| 12 | B-12 | $-C_4H_9$ | $-CH_2-CH(C_6H_5)-$ | 70/20 |
| 13 | B-13 | " | $-CH_2-CH(CN)-$ | 80/10 |
| 14 | B-14 | $-C_4H_9$ | $-CH_2-CH(COO(CH_2)_2CN)-$ | 75/15 |
| 15 | B-15 | $-CH_2C_6H_5$ | $-CH_2-C(CH_3)(COO(CH_2)_2OH)-$ | 80/10 |
| 16 | B-16 | $-C_2H_5$ | $-CH_2-CH(CONH_2)-$ | 85/5 |
| 17 | B-17 | $-C_2H_5$ | $-CH_2-C(CH_3)(COO(CH_2)_2N\langle O\rangle)-$ | 85/5 |
| 18 | B-18 | $-C_2H_5$ | $-CH_2-CH(C_6H_4-CH_3)-$ | 75/15 |
| 19 | B-19 | $-C_6H_4-CH_3$ | $-CH_2-C(CH_3)(COOC_2H_5)-$ | 70/20 |

TABLE 2-continued

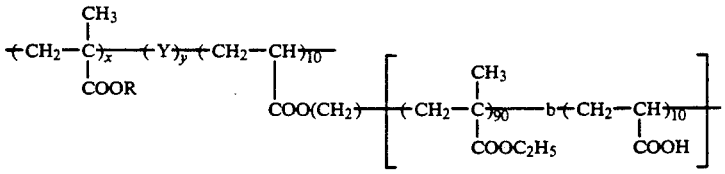

x + y + 10 = 100 (by weight)

| Synthesis Example No. | Resin (B) | —R | —Y— | x/y |
|---|---|---|---|---|
| 20 | B-20 | 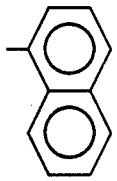 | $-CH_2-CH(COOC_2H_5)-$ | 70/20 |

EXAMPLE 1

A mixture of 6 g (solid basis, hereinafter the same) of Resin (A-3), 34 g (solid basis, hereinafter the same) of Resin (B-1), 200 g of zinc oxide, 0.018 g of Cyanine Dye (I) shown below, and 300 g of toluene was dispersed in a ball mill for 4 hours to prepare a coating composition for a light-sensitive layer. The coating composition was coated on paper, which has been subjected to electrically conductive treatment, by a wire bar at a dry coverage of 25 g/m$^2$, followed by drying at 110° C. for 30 seconds. The coated material was then allowed to stand in a dark place at 20° C. and 65% RH (relative humidity) for 24 hours to prepare an electrophotographic light-sensitive material.

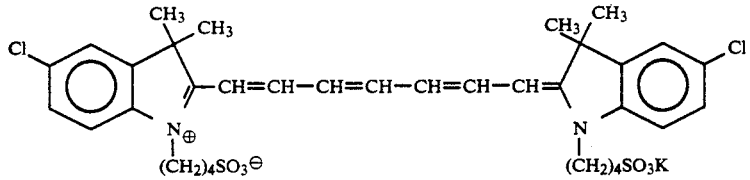

Cyanine Dye (I):

COMPARATIVE EXAMPLE A

An electrophotographic light-sensitive material was prepared in the same manner as in Example 1, except for using 6 g of Resin (R-1) shown below and 34 g of poly(ethyl methacrylate) having an Mw of $2.4\times10^5$ (Resin (R-2)) in place of the resins used in Example 1.

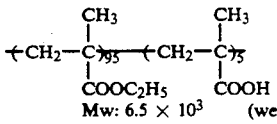

(R-1)

Mw: $6.5 \times 10^3$ (weight ratio)

COMPARATIVE EXAMPLE B

An electrophotographic light-sensitive material was prepared in the same manner as in Example 1, except for using 6 g of Resin (R-3)shown below and 34 g of Resin (R-2) in place of the resins used in Example 1.

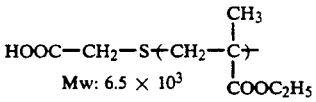

(R-3)

Mw: $6.5 \times 10^3$

COMPARATIVE EXAMPLE C

An electrophotographic light-sensitive material was prepared in the same manner as in Example 1, except for using 6 g of Resin (R-3) and 34 g of Resin (R-4) shown below in place of the resins used in Example 1.

(R-4)

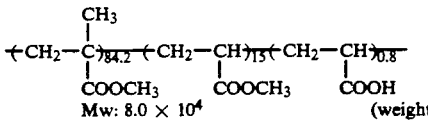

Mw: $8.0 \times 10^4$ (weight ratio)

Each of the light-sensitive materials obtained in Example 1 and Comparative Examples A, B and C was evaluated for film properties in terms of surface smoothness and mechanical strength; electrostatic characteristics; image forming performance; oil-desensitivity when used as an offset master plate precursor (expressed in terms of contact angle of the layer with water after oil-desensitization treatment); and printing suitability (expressed in terms of background stains and printing durability) according to the following test methods. The results obtained are shown in Table 3 below.

1) Smoothness of Photoconductive Layer

The smoothness (sec/cc) was measured using a Beck's smoothness tester (manufactured by Kumagaya Riko K.K.) under an air volume condition of 1 cc.

2) Mechanical Strength of Photoconductive Layer

The surface of the light-sensitive material was repeatedly (1000 times) rubbed with emery paper (#1000) under a load of 60 g/cm$^2$ using a Heidon 14 Model surface testing machine (manufactured by Shinto Kagaku K.K.). After dusting, the abrasion loss of the photoconductive layer was measured to obtain film retention (%).

3) Electrostatic Characteristics

The sample was charged with a corona discharge to a voltage of −6 kV for 20 seconds in a dark room at 20° C. and 65% RH using a paper analyzer ("Paper Analyzer SP-428" manufactured by Kawaguchi Denki K.K.). Ten seconds after the corona discharge, the surface potential $V_{10}$ was measured. The sample was allowed to stand in the dark for an additional 120 seconds, and the potential $V_{130}$ was measured. The dark decay retention rate (DRR; %), i.e., percent retention of potential after dark decay for 120 seconds, was calculated from the following equation:

$$DRR\ (\%) = (V_{130}/V_{10}) \times 100$$

Separately, the sample was charged to −500 V with a corona discharge and then exposed to monochromatic light having a wavelength of 785 nm, and the time required for decay of the surface potential $V_{10}$ to one-tenth was measured to obtain an exposure amount $E_{1/10}$ (erg/cm$^2$).

Further, the sample was charged to −500 V with a corona discharge in the same manner as described for the measurement of $E_{1/10}$, then exposed to monochromatic light having a wavelength of 785 nm, and the time required for decay of the surface potential $V_{10}$ to one-hundredth was measured to obtain an exposure amount $E_{1/100}$ (erg/cm$^2$).

The measurements were conducted under conditions of 20° C. and 65% RH (hereinafter referred to as Condition I) or 30° C. and 80% RH (hereinafter referred to as Condition II).

4) Image Forming Performance

After the samples were allowed to stand for one day under Condition I or II, each sample was charged to −5 kV and exposed to light emitted from a gallium-aluminum-arsenic semi-conductor laser (oscillation wavelength: 785 nm; output: 2.8 mW) at an exposure amount of 50 erg/cm$^2$ (on the surface of the photoconductive layer) at a pitch of 25 μm and a scanning speed of 300 m/sec. The thus formed electrostatic latent image was developed with a liquid developer ("ELP-T" produced by Fuji Photo Film Co., Ltd.), followed by fixing. The duplicated image obtained was visually evaluated for fog and image quality.

5) Contact Angle With Water

The sample was passed once through an etching processor using an oil-desensitizing solution ("ELP-EX" produced by Fuji Photo Film Co., Ltd.) diluted to a two-fold volume with distilled water to render the surface of the photoconductive layer oil-desensitive. On the thus oil-desensitized surface was placed a drop of 2 μl of distilled water, and the contact angle formed between the surface and water was measured using a goniometer.

6) Printing Durability

The sample was processed in the same manner as described in 4) above to form toner images, and the surface of the photoconductive layer was subjected to oil-desensitization treatment under the same conditions as in 5) above. The resulting lithographic printing plate was mounted on an offset printing machine ("Oliver Model 52", manufactured by Sakurai Seisakusho K.K.), and printing was carried out on paper. The number of prints obtained until background stains in the non-image areas appeared or the quality of the image areas was deteriorated was taken as the printing durability. The larger the number of the prints, the higher the printing durability.

TABLE 3

| | | Example 1 | Comparative Example A | Comparative Example B | Comparative Example C |
|---|---|---|---|---|---|
| Surface Smoothness[1] (sec/cc) | | 450 | 430 | 410 | 430 |
| Film Strength[2] (%) | | 98 | 80 | 80 | 92 |
| Electrostatic[3] Characteristics: | | | | | |
| $V_{10}$ (−V): | Condition I | 680 | 490 | 500 | 520 |
| | Condition II | 665 | 405 | 455 | 480 |
| DRR (%): | Condition I | 90 | 63 | 70 | 75 |
| | Condition II | 87 | 48 | 62 | 67 |
| $E_{1/10}$ (erg/cm$^2$): | Condition I | 16 | 65 | 50 | 45 |
| | Condition II | 18 | 50 | 41 | 42 |
| $E_{1/100}$ (erg/cm$^2$): | Condition I | 22 | 105 | 88 | 70 |
| | Condition II | 25 | 120 | 105 | 90 |
| Image-Forming Performance[4]: | Condition I | Very Good | Poor (reduced Dmax, background fog) | No Good (scratches of fine lines or letters, slight background fog) | No Good (scratches of fine lines or letters) |
| | Condition II | Very Good | Very Poor (reduced Dmax, background fog) | Poor (reduced Dmax, background fog) | No Good (slight reduced Dmax, background fog) |
| Contact Angle[5] With Water (°) | | 10 or less | 10 or less | 10 or less | 10 or less |
| Printing Durability[6]: | | 10,000 or more | Background stains from the start of | Background stains from the start of | Background stains from the start of |

TABLE 3-continued

| | Example 1 | Comparative Example A | Comparative Example B | Comparative Example C |
|---|---|---|---|---|
| | | printing | printing | printing |

As can be seen from the results shown in Table 3, the light-sensitive material according to the present invention had good surface smoothness, film strength and electrostatic characteristics. The duplicated image obtained was clear and free from background fog in the non-image area. These results appear to be due to sufficient adsorption of the binder resin onto the photoconductive substance and sufficient covering of the surface of the particles with the binder resin. For the same reason, when it was used as an offset master plate precursor, oil-desensitization of the offset master plate precursor with an oil-desensitizing solution was sufficient to render the non-image areas satisfactorily hydrophilic, as shown by a small contact angle of 10° C. or less with water. On practical printing using the resulting master plate, no background stains were observed in the prints.

The samples of Comparative Examples A and B exhibited poor electrostatic characteristics as compared with the light-sensitive material according to the present invention. The sample of Comparative Example C had improved film strength and almost satisfactory value on the electrostatic characteristics of $V_{10}$, DRR and $E_{1/10}$. However, with respect to $E_{1/100}$, the value obtained was greater than about three time the value of the light-sensitive material according to the present invention.

The value of $E_{1/100}$ indicated an electrical potential remaining in the non-image areas after exposure at the practice of image formation. The smaller this value, the less the background fog in the non-image areas. More specifically, it is required that the remaining potential is decreased to −10V or less. Therefore, an amount of exposure necessary to make the remaining potential below −10V is an important factor. In the scanning exposure system using a semiconductor laser beam, it is quite important to make the remaining potential below −10V by a small exposure amount in view of a design for an optical system of a duplicator (such as cost of the device, and accuracy of the optical system).

When the sample of Comparative Example A was actually imagewise exposed by a device of a small amount of exposure, satisfactory duplicated image was not obtained due to the low value of DRR. In the case of the sample of Comparative Example B, the noticeable degradation of duplicated image, that is, the decrease in image density and occurrence of scratches of fine lines or letters in the image areas and background fog in the non-image areas were observed under high temperature and high humidity conditions. In the case of the sample of Comparative Example C, the occurrence of background fog and scratches of fine lines in the image areas were observed under high temperature and high humidity conditions, while almost satisfactory images were obtained under the normal temperature and humidity condition.

Furthermore, when these samples were employed as offset master plate precursors, the samples of Comparative Examples A, B and C exhibited the background stains in the non-image area from the start of printing under the printing conditions under which the sample according to the present invention provided more than 10,000 prints of good quality. This is because the background fog of the non-image area in the samples of Comparative Examples could not be removed by the oil-desensitizing treatment.

From all these considerations, it is thus clear that an electrophotographic light-sensitive material satisfying both requirements of electrostatic characteristics and printing suitability can be obtained only using the binder resin according to the present invention.

EXAMPLES 2 TO 17

An electrophotographic light-sensitive material was prepared in the same manner as described in Example 1, except for replacing Resin (A-3) and Resin (B-1) with each of Resins (A) and (B) shown in Table 4 below, respectively.

The electrostatic characteristics of the resulting light-sensitive materials were evaluated in the same manner as described in Example 1. The results obtained are shown in Table 4 below. The electrostatic characteristics in Table 4 are those determined under Condition II (30° C. and 80% RH).

TABLE 4

Resin (A)

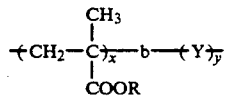

| Example No. | Resin (A) | —R | —Y— | x/y | Resin (B) | $V_{10}$ (−v) | DRR (%) | $E_{1/100}$ (erg/cm$^2$) |
|---|---|---|---|---|---|---|---|---|
| 2 | A-5 | $-CH_2C_6H_5$ | $-CH_2-C(CH_3)(COOH)-$ | 95/5 | B-2 | 550 | 75 | 50 |

TABLE 4-continued
Resin (A)
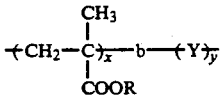
| Example No. | Resin (A) | —R | —Y— | x/y | Resin (B) | $V_{10}$ (−v) | DRR (%) | $E_{1/100}$ (erg/cm$^2$) |
|---|---|---|---|---|---|---|---|---|
| 3 | A-6 | 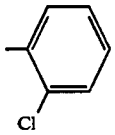 | " | 95/5 | B-3 | 610 | 88 | 25 |
| 4 | A-7 | 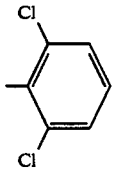 | 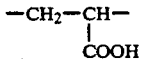 | 95/5 | B-4 | 650 | 85 | 23 |
| 5 | A-8 | 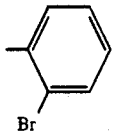 | 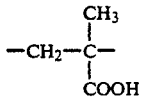 | 95/5 | B-5 | 580 | 82 | 28 |
| 6 | A-9 | 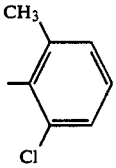 | " | 95/5 | B-6 | 655 | 89 | 30 |
| 7 | A-10 | 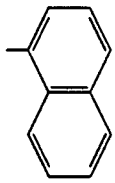 | " | 95/5 | B-8 | 560 | 83 | 33 |
| 8 | A-11 | 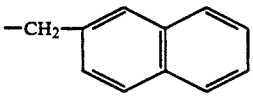 | 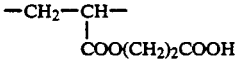 | 94/6 | B-9 | 550 | 85 | 30 |
| 9 | A-12 | 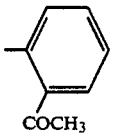 | 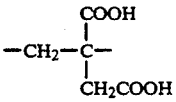 | 96/4 | B-10 | 550 | 85 | 35 |
| 10 | A-13 | 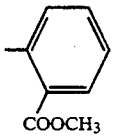 | 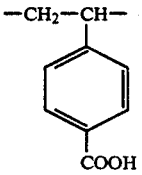 | 94.5/5.5 | B-11 | 545 | 79 | 40 |

TABLE 4-continued

Resin (A)

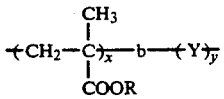

| Example No. | Resin (A) | —R | —Y— | x/y | Resin (B) | $V_{10}$ (−v) | DRR (%) | $E_{1/100}$ (erg/cm$^2$) |
|---|---|---|---|---|---|---|---|---|
| 11 | A-14 | 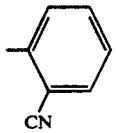 | 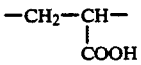 | 95/5 | B-12 | 530 | 75 | 45 |
| 12 | A-15 | $-CH_2C_6H_5$ | 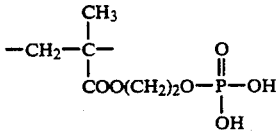 | 96/4 | B-13 | 550 | 78 | 54 |
| 13 | A-16 | 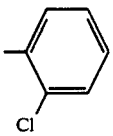 | 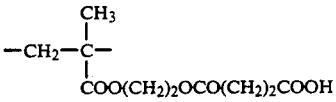 | 94/6 | B-14 | 630 | 86 | 28 |
| 14 | A-17 | $-C_2H_5$ | 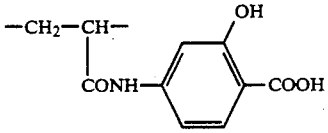 | 95/5 | B-15 | 520 | 74 | 65 |
| 15 | A-18 | 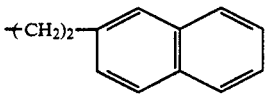 | 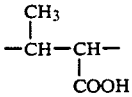 | 95/5 | B-16 | 540 | 75 | 50 |
| 16 | A-19 | $-C_6H_5$ | 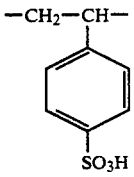 | 97/3 | B-18 | 555 | 79 | 46 |
| 17 | A-20 | 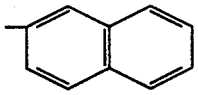 | 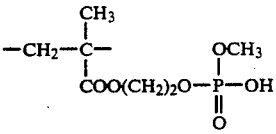 | 92/8 | B-19 | 570 | 84 | 30 |

Further, when these electrophotographic light-sensitive materials were employed as offset master plate precursors under the same printing condition as described in Example 1, more than 10,000 good prints were obtained respectively.

It can be seen from the results described above that each of the light-sensitive materials according to the present invention was satisfactory in all aspects of the surface smoothness and film strength of the photoconductive layer, electrostatic characteristics, and printing suitability.

Further, it can be seen that the electrostatic characteristics are further improved by the use of the resin (A').

EXAMPLES 18 TO 33

An electrophotographic light-sensitive material was prepared in the same manner as described in Example 1, except for replacing 6 g of Resin (A-3) with 7.6 g each of Resins (A) shown in Table 5 below, replacing 34 g of Resin (B-1) with 34 g each of Resins (B) shown in Table 5 below, and replacing 0.018 g of Cyanine Dye (I) with 0.019 g of Cyanine Dye (II) shown below.

Cyanine Dye (II):

-continued

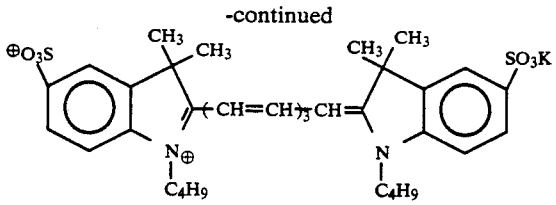

TABLE 5

| Example No. | Resin (A) | Resin (B) |
|---|---|---|
| 18 | A-3 | B-10 |
| 19 | A-3 | B-8 |
| 20 | A-4 | B-11 |
| 21 | A-6 | B-18 |
| 22 | A-6 | B-9 |
| 23 | A-10 | B-3 |
| 24 | A-10 | B-10 |
| 25 | A-10 | B-14 |
| 26 | A-15 | B-5 |
| 27 | A-15 | B-7 |
| 28 | A-15 | B-13 |
| 29 | A-7 | B-18 |
| 30 | A-7 | B-2 |
| 31 | A-7 | B-9 |
| 32 | A-19 | B-1 |
| 33 | A-19 | B-16 |

As the results of the evaluation as described in Example 1, it can be seen that each of the light-sensitive materials according to the present invention is excellent in charging properties, dark charge retention rate, and photosensitivity, and provides a clear duplicated image free from background fog even when processed under severe conditions of high temperature and high humidity (30° C. and 80% RH). Further, when these materials were employed as offset master plate precursors, more than 10,000 prints of a clear image free from background stains were obtained respectively.

EXAMPLES 34 AND 35

A mixture of 6.5 g of Resin (A-2) (Example 34) or Resin (A-16) (Example 35), 33.5 g of Resin (B-12), 200 g of zinc oxide, 0.02 g of uranine, 0.04 g of Rose Bengale, 0.03 g of bromophenol blue, 0.20 g of phthalic anhydride, and 300 g of toluene was dispersed in a ball mill for 4 hours to prepare a coating composition for a light-sensitive layer. The coating composition was coated on paper, which had been subjected to electrically conductive treatment, by a wire bar at a dry coverage of 20 g/m$^2$, and dried for one minute at 110° C. Then, the coated material was allowed to stand in a dark place for 24 hours under the conditions of 20° C. and 65% RH to prepare each electrophotographic light-sensitive material.

COMPARATIVE EXAMPLE D

An electrophotographic light-sensitive material was prepared in the same manner as in Example 34, except for replacing 6.5 g of Resin (A-2) with 6.5 g of Resin (R-3), and replacing 33.5 g of Resin (B-12) with 33.5 g of Resin (R-4).

Each of the light-sensitive materials obtained in Examples 34 and 35 and Comparative Example D was evaluated in the same manner as in Example 1, except that the electrostatic characteristics and image forming performance were evaluated according to the following test methods.

7) Electrostatic Characteristics: $E_{1/10}$ and $E_{1/100}$

The surface of the photoconductive layer was charged to −400 V with corona discharge, then irradiated by visible light of the illuminance of 2.0 lux, the time required for decay of the surface potential ($V_{10}$) to 1/10 or 1/100 thereof, and the exposure amount $E_{1/10}$ or $E_{1/100}$ (lux·sec) was calculated therefrom.

8) Image Forming Performance

The electrophotographic light-sensitive material was allowed to stand for one day under the environmental conditions of 20° C. and 65% RH (Condition I) or 30° C. and 80% RH (Condition II), the light-sensitive material was subjected to plate making by a full-automatic plate making machine (ELP-404V made by Fuji Photo Film Co., Ltd.) using ELP-T as a toner. The duplicated image thus obtained was visually evaluated for fog and image quality. The original used for the duplication was composed of cuttings of other originals pasted up thereon.

The results obtained are shown in Table 6 below.

TABLE 6

| | | Example 34 | Example 35 | Comparative Example D |
|---|---|---|---|---|
| Binder Resin | | (A-2)/(B-12) | (A-16)/(B-12) | (R-3)/(R-4) |
| Surface Smoothness (sec/cc) | | 380 | 400 | 405 |
| Film Strength (%) | | 96 | 98 | 95 |
| Electrostatic[7] Characteristics: | | | | |
| $V_{10}$ (−V): | Condition I | 585 | 685 | 540 |
| | Condition II | 570 | 675 | 515 |
| DRR (%): | Condition I | 90 | 96 | 90 |
| | Condition II | 88 | 94 | 86 |
| $E_{1/10}$ (lux · sec): | Condition I | 10.6 | 8.0 | 14.5 |
| | Condition II | 11.5 | 8.8 | 15.6 |
| $E_{1/100}$ (lux · sec): | Condition I | 23 | 17 | 33 |
| | Condition II | 26 | 19 | 38 |
| Image-Forming Performance[8]: | Condition I | Good | Very Good | Poor (edge mark of cutting) |
| | Condition II | Good | Very Good | Poor (sever edge mark of cutting) |
| Contact Angle With Water (°) | | 10 or less | 10 or less | 10 or less |
| Printing Durability: | | 10,000 | 10,000 | Background stains due to edge mark of cutting from the |

TABLE 6-continued

| | Example 34 | Example 35 | Comparative Example D |
|---|---|---|---|
| | | | start of printing |

From the results shown in Table 6 above, it can be seen that each light-sensitive material exhibits almost same properties with respect to the surface smoothness and mechanical strength of the photoconductive layer. However, on the electrostatic characteristics, the sample of Comparative Example D has the particularly large value of $E_{1/100}$. On the contrary, the electrostatic characteristics of the light-sensitive material according to the present invention are good. Further, those of Example 35 using the resin (A') having the specific substituent are very good. The value of $E_{1/100}$ is particularly small.

With respect to image-forming performance, the edge mark of cuttings pasted up was observed as background fog in the non-image areas in the sample of Comparative Example D. On the contrary, the samples according to the present invention provided clear duplicated images free from background fog.

Further, each of these samples was subjected to the oil-desensitizing treatment to prepare an offset printing plate and printing was conducted. The samples according to the present invention provided 10,000 prints of clear image without background stains. However, with the sample of Comparative Example D, the above described edge mark of cuttings pasted up was not removed with the oil-desensitizing treatment and the background stains occurred from the start of printing As can be seen from the above results, only the light-sensitive material according to the present invention can provide the excellent performance.

EXAMPLES 36 TO 49

An electrophotographic light-sensitive material was prepared in the same manner as described in Example 34, except for replacing 6.5 g Resin (A-2) with 6.5 g of each of Resins (A) shown in Table 7 below, and replacing 33.5 g of Resin (B-12) with 33.5 g of each of Resins (B) shown in Table 7 below.

TABLE 7

| Example No. | Resin (A) | Resin (B) |
|---|---|---|
| 36 | A-1 | B-6 |
| 37 | A-2 | B-4 |
| 38 | A-3 | B-7 |
| 39 | A-4 | B-9 |
| 40 | A-5 | B-10 |
| 41 | A-6 | B-11 |
| 42 | A-7 | B-12 |
| 43 | A-8 | B-13 |
| 44 | A-9 | B-14 |
| 45 | A-11 | B-16 |
| 46 | A-12 | B-18 |
| 47 | A-17 | B-20 |
| 48 | A-19 | B-2 |
| 49 | A-20 | B-3 |

As the results of the evaluation as described in Example 34, it can be seen that each of the light-sensitive materials according to the present invention is excellent in charging properties, dark charge retention rate, and photosensitivity, and provides a clear duplicated image free from background fog and scratches of fine lines even when processed under severe conditions of high temperature and high humidity (30° C. and 80% RH). Further, when these materials were employed as offset master plate precursors, 10,000 prints of a clear image free from background stains were obtained respectively.

EXAMPLE 50

A mixture of 8 g of Resin (A-21) shown below and 28 g of Resin (B-15), 200 g of zinc oxide, 0.02 g of uranine, 0.04 g of Rose Bengal, 0.03 g of bromophenol blue, 0.20 g of phthalic anhydride and 300 g of toluene was dispersed in a ball mill for 4 hours. Then, to the dispersion was added 3.5 g of 1,3-xylylenediisocyanate, and the mixture was dispersed in a ball mill for 5 minutes.

The dispersion was coated on paper, which had been subjected to an electroconductive treatment, by a wire bar in a dry coverage of 18 g/m$^2$, heated for 30 seconds at 110° C. and then heated for 2 hours at 120° C. Then, the coated material was allowed to stand for 24 hours under the condition of 20° C. and 65% RH to prepare an electrophotographic light-sensitive material.

(A-21)

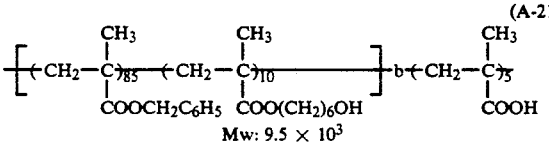

Mw: 9.5 × 10$^3$

As the results of the evaluation as described in Example 34, it can be seen that the light-sensitive material according to the present invention is excellent in charging properties, dark charge retention rate, and photosensitivity, and provides a clear duplicated image free from background fog under severe conditions of high temperature and high humidity (30° C. and 80% RH). Further, when the material was employed as an offset master plate precursor, 10,000 prints of a clear image free from background stains were obtained.

While the invention has been described in detail and with reference to specific embodiments thereof, it will be apparent to one skilled in the art that various changes and modifications can be made therein without departing from the spirit and scope thereof.

What is claimed is:

1. An electrophotographic light-sensitive material comprising a support having provided thereon at least one photoconductive layer containing an inorganic photoconductive substance and a binder resin, wherein the binder resin comprises (A) at least one AB block copolymer (Resin (A)) having a weight average molecular weight of from $1\times10^3$ to $2\times10^4$ and composed of an A block comprising at least one polymer component containing at least one acidic group selected from —$PO_3H_2$, —COOH, —$SO_3H$, a phenolic hydroxy group,

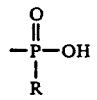

(wherein R represents a hydrocarbon group or —OR' (wherein R' represents a hydrocarbon group)) and a cyclic acid anhydride-containing group, and a B block containing at least a polymer component represented by the following general formula (I):

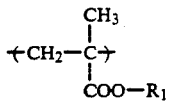

(I)

wherein $R_1$ represents a hydrocarbon group; and (B) at least one graft type copolymer (Resin (B)) having a weight average molecular weight of from $3\times10^4$ to $1\times10^6$ and containing, as a copolymerizable component, at least one monofunctional macromonomer (M) having a weight average molecular weight of from $1\times10^3$ to $2\times10^4$ and comprising an MAB block copolymer composed of an MA block comprising at least one polymer component containing at least one acidic group selected from $—PO_3H_2$, —COOH, $—SO_3H$, a phenolic hydroxyl group,

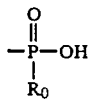

(wherein $R_0$ represents a hydrocarbon group or $—OR_0'$ (wherein $R_0'$ represents a hydrocarbon group)) and a cyclic acid anhydride-containing group, and an MB block containing at least one polymer component represented by the general formula (III) described below and having a polymerizable double bond group bonded to the terminal of the main chain of the MB block polymer:

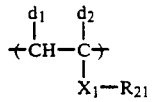

(III)

wherein $d_1$ and $d_2$ each represents a hydrogen atom, a halogen atom, a cyano group, a hydrocarbon group, $—COOR_{24}$ or $—COOR_{24}$ bonded via a hydrocarbon group (wherein $R_{24}$ represents a hydrocarbon group); $X_1$ represents —COO—, —OCO—, $-(CH_2)_{l_1}OCO—$, $-(CH_2)_{l_2}COO—$ (wherein $l_1$ and $l_2$ each represents an integer of from 1 to 3), —O—, $—SO_2—$, —CO—,

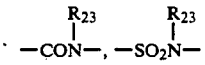

(wherein $R_{23}$ represents a hydrogen atom or a hydrocarbon group), —CONHCOO—, —CONHCONH—, or

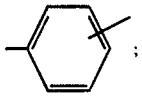

and $R_{21}$ represents a hydrocarbon group, provided that when $X_1$ represents

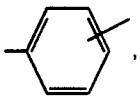

$R_{21}$ represents a hydrogen atom or a hydrocarbon group.

2. An electrophotographic light-sensitive material as claimed in claim 1, wherein the polymer component represented by the general formula (I) is a polymerizable component represented by the following general formula (Ia) or (Ib):

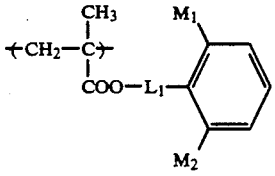

(Ia)

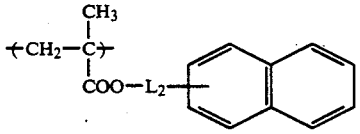

(Ib)

wherein $M_1$ and $M_2$ each represents a hydrogen atom, a hydrocarbon group having from 1 to 10 carbon atoms, a chlorine atom, a bromine atom, $—COZ_2$ or $—COOZ_2$, wherein $Z_2$ represents a hydrocarbon group having from 1 to 10 carbon atoms; and $L_1$ and $L_2$ each represents a mere bond or a linking group containing from 1 to 4 linking atoms, which connects —COO— and the benzene ring.

3. An electrophotographic light-sensitive material as claimed in claim 1, wherein the content of the copolymer component represented by the general formula (I) in the B block is from 30 to 100% by weight based on the total weight of the B block.

4. An electrophotographic light-sensitive material as claimed in claim 2, wherein the linking group containing from 1 to 4 linking atoms represented by $L_1$ or $L_2$ is $-(CH_2)_{n_1}-$ ($n_1$ represents an integer of 1, 2 or 3), $—CH_2CH_2OCO—$, $-(CH_2O)_{n_2}-$ ($n_2$ represents an integer of 1 or 2), or $—CH_2CH_2O—$.

5. An electrophotographic light-sensitive material as claimed in claim 1, wherein the block B further contains a polymer component represented by the following general formula (II):

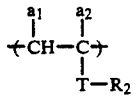

(II)

wherein T represents —COO—, —OCO—, $-(CH_2)_{m_1}OCO—$, $-(CH_2)_{m_2}COO—$, —O—, $—SO_2—$,

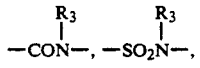

—CONHCOO—, —CONHCONH— or

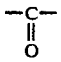

(wherein $m_1$ and $m_2$ each represents an integer of 1 or 2, $R_3$ has the same meaning as $R_1$ in the general formula (I)); $R_2$ has the same meaning as $R_1$ in the general formula (I); and $a_1$ and $a_2$, which may be same or different, each represents a hydrogen atom, a halogen atom, a cyano group, a hydrocarbon group having from 1 to 8 carbon atoms, —COO—$Z_3$ or —COO—$Z_3$ bonded via a hydrocarbon group having from 1 to 8 carbon atoms (wherein $Z_3$ represents a hydrocarbon group having from 1 to 18 carbon atoms).

6. An electrophotographic light-sensitive material as claimed in claim 1, wherein the content of the polymer component containing the acidic group in the AB block copolymer is from 0.5 to 20 parts by weight per 100 parts by weight of the AB block copolymer.

7. An electrophotographic light-sensitive material as claimed in claim 1, wherein the graft type copolymer contains the macromonomer (M) and a polymer component represented by the following general formula (IV):

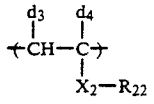

(IV)

wherein $d_3$ and $d_4$ each represents a hydrogen atom, a halogen atom, a cyano group, a hydrocarbon group, —$COOR_{24}$ or —$COOR_{24}$ bonded via a hydrocarbon group (wherein $R_{24}$ represents a hydrocarbon group; $X_2$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, —$SO_2$—, —CO—,

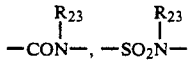

(wherein $R_{23}$ represents a hydrogen atom or a hydrocarbon group), —CONHCOO—, —CONHCONH—, or

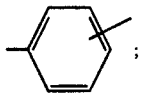

;

and $R_{22}$ represents a hydrocarbon group, provided that, when $X_1$ represents

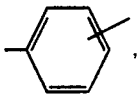

, $R_{22}$ represents a hydrogen atom or a hydrocarbon group.

8. An electrophotographic light-sensitive material as claimed in claim 1, wherein the acidic group in the MA block is —COOH, —$SO_3H$, a phenolic hydroxyl group or

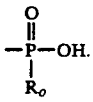

9. An electrophotographic light-sensitive material as claimed in claim 1, wherein the polymerizable double bond group is a group represented by the following general formula (V):

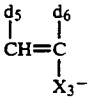

(V)

wherein $d_5$ and $d_6$ each represents a hydrogen atom, a halogen atom, a cyano group, a hydrocarbon group, —$COOR_{24}$ or —$COOR_{24}$ bonded via a hydrocarbon group (wherein $R_{24}$ represents a hydrocarbon group; and $X_3$ represents —COO—, —OCO—, $-(CH_2)_{l_1}OCO-$, $-(CH_2)_{l_2}COO-$ (wherein $l_1$ and $l_2$ each represents an integer of from 1 to 3), —O—, —$SO_2$—, —CO—,

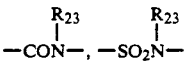

(wherein $R_{23}$ represents a hydrogen atom or a hydrocarbon group), —CONHCOO—, —CONHCONH—, or

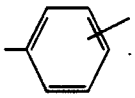

.

10. An electrophotographic light-sensitive material as claimed in claim 1, wherein a ratio of the MA block/the MB block in the resin (B) is 1 to 30/99 to 70 by weight.

11. An electrophotographic light-sensitive material as claimed in claim 7, wherein a ratio of the macromonomer (M)/the monomer of the general formula (IV) is 1 to 60/99 to 40 by weight.

12. An electrophotographic light-sensitive material as claimed in claim 1, wherein a ratio of the AB block copolymer/the graft type copolymer is 5 to 50/95 to 50 by weight.

* * * * *